US010067457B2

(12) United States Patent
Fujiwara et al.

(10) Patent No.: US 10,067,457 B2
(45) Date of Patent: Sep. 4, 2018

(54) FIXING APPARATUS INCORPORATING A NOVEL HEATER CONFIGURATION FOR HIGH SPEED PRINTING

(71) Applicant: CANON KABUSHIKI KAISHA, Tokyo (JP)

(72) Inventors: Yuji Fujiwara, Susono (JP); Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/145,596

(22) Filed: May 3, 2016

(65) Prior Publication Data

US 2016/0327898 A1 Nov. 10, 2016

(30) Foreign Application Priority Data

May 8, 2015 (JP) ..... 2015-095775

(51) Int. Cl.

| | |
|---|---|
| ***G03G 15/20*** | (2006.01) |
| ***G03G 15/00*** | (2006.01) |
| ***H05B 1/02*** | (2006.01) |
| ***H05B 3/14*** | (2006.01) |

(52) U.S. Cl.

CPC ..... *G03G 15/80* (2013.01); *G03G 15/2039* (2013.01); *H05B 1/0202* (2013.01); *H05B 1/0241* (2013.01); *H05B 3/141* (2013.01); *G03G 2215/2035* (2013.01)

(58) Field of Classification Search

None

See application file for complete search history.

(56) References Cited

U.S. PATENT DOCUMENTS

| | | | | |
|---|---|---|---|---|
| 6,301,454 | B1 | 10/2001 | Nishida | |
| 2007/0116485 | A1 | 5/2007 | Nishida | |
| 2011/0095011 | A1* | 4/2011 | Kawazu | G03G 15/2039 219/216 |
| 2013/0322908 | A1 | 12/2013 | Ogura | |

FOREIGN PATENT DOCUMENTS

| | | | |
|---|---|---|---|
| JP | 2011-187238 | A | 9/2011 |
| JP | 5479025 | B2 | 4/2014 |
| JP | 2014-222328 | A | 11/2014 |

* cited by examiner

*Primary Examiner* — Sevan A Aydin

(74) *Attorney, Agent, or Firm* — Canon USA, Inc., IP Division

(57) ABSTRACT

A controller controls first and second switching elements so that, in both of the waveforms of alternating currents flowing through the first and second heating elements, a first period including both of a phase control waveform in which a current flows in a part of a half cycle of alternately current and a wave-number control waveform in which a current flows or does not flow over a half cycle of alternately current and a second period including only the wave-number control waveform alternately appear in a control cycle; when the first heating element operates in the first/second period, the second heating element operates in the second/first period; and both the waveforms of the alternating currents flowing through the first and second heating elements are electrically symmetric in the positive and negative directions during the control cycle.

17 Claims, 28 Drawing Sheets

FIXING APPARATUS INCORPORATING A NOVEL HEATER CONFIGURATION FOR HIGH SPEED PRINTING

BACKGROUND OF THE INVENTION

Field of the Invention

The present invention relates to a fixing apparatus included in an image forming apparatus, such as an electrophotographic copying machine or an electrophotographic printer.

Description of the Related Art

The processing speed of an image forming apparatus, such as an electrophotographic copying machine or an electrophotographic printer, has been remarkably increased. To perform printing at high speed, power supplied to a heater of a fixing device needs to be increased. However, increase in power supplied to a heater makes it difficult to suppress the occurrence of harmonic current and flicker.

In Japanese Patent Publication No. 5479025, a power control method for suppressing the occurrence of harmonic current and flicker is disclosed.

However, to achieve further increases in speed of an image forming apparatus while suppressing the occurrence of harmonic current and flicker, further innovation in power control is required.

SUMMARY OF THE INVENTION

The present invention provides a fixing apparatus which addresses the requirement for increased speed of an image forming apparatus while suppressing the occurrence of harmonic current and flicker.

According to an aspect of the present invention there is provided a fixing apparatus that includes a first heating element, a second heating element, a first switching element positioned in a power supply path from an alternating-current power supply to the first heating element, a second switching element positioned in a power supply path from the alternating-current power supply to the second heating element, and a controller configured to control power supplied from the alternating-current power supply to the first heating element and the second heating element, for each control cycle which is a period of a plurality of predetermined cycles of alternating current flowing from the alternating-current power supply. An image formed on a recording medium is thermally fixed on the recording medium by using heat generated by the first heating element and the second heating element. When total power, comprising the power supplied to the first heating element and the power supplied to the second heating element, in a period of the control cycle is set to a level which is equal to or less than a predetermined level, the controller is arranged to control the first switching element and the second switching element in such a manner that three following rules are satisfied. Rule 1: in both of a waveform of an alternating current flowing through the first heating element and a waveform of an alternating current flowing through the second heating element, a first period and a second period alternately appear in the period of the control cycle, the first period including both of a phase control waveform in which a current flows in a part of a half cycle of alternately current and a wave-number control waveform in which a current flows or does not flow over a half cycle of alternately current, the second period including only the wave-number control waveform. Rule 2: when the first heating element operates in the first period, the second heating element operates in the second period, and when the first heating element operates in the second period, the second heating element operates in the first period. Rule 3: both the waveform of the alternating current flowing through the first heating element and the waveform of the alternating current flowing through the second heating element are electrically symmetric in the positive and negative directions during the period of the control cycle.

According to another aspect of the present invention, there is a provided a fixing apparatus including a first heating element, a second heating element, a first switching element positioned in a power supply path from an alternating-current power supply to the first heating element, a second switching element positioned in a power supply path from the alternating-current power supply to the second heating element, and a controller configured to control power supplied from the alternating-current power supply to the first heating element and the second heating element, for each control cycle which is a period of a plurality of predetermined cycles of alternating current flowing from the alternating-current power supply. An image formed on a recording medium is thermally fixed on the recording medium by using heat generated by the first heating element and the second heating element. When total power, comprising the power supplied to the first heating element and the power supplied to the second heating element, in a period of the control cycle is set to a level which is equal to or less than a predetermined level, the controller is arranged to control the first switching element and the second switching element in such a manner that three following rules are satisfied. Rule 1: in both of a waveform of an alternating current flowing through the first heating element and a waveform of an alternating current flowing through the second heating element, a first period and a second period alternately appear in a period twice the period of the control cycle, the first period including both of a phase control waveform in which a current flows in a part of a half cycle of alternately current and a wave-number control waveform in which a current flows or does not flow over a half cycle of alternately current, the second period including only the wave-number control waveform. Rule 2: when the first heating element operates in the first period, the second heating element operates in the second period, and when the first heating element operates in the second period, the second heating element operates in the first period. Rule 3: both the waveform of the alternating current flowing through the first heating element and the waveform of the alternating current flowing through the second heating element are electrically symmetric in the positive and negative directions during the period of the control cycle.

Further features of the present invention will become apparent from the following description of exemplary embodiments with reference to the attached drawings. Each of the embodiments of the present invention described below can be implemented solely or as a combination of a plurality of the embodiments or features thereof where necessary or where the combination of elements or features from individual embodiments in a single embodiment is beneficial.

DESCRIPTION OF THE EMBODIMENTS

First Embodiment

Figure 1:
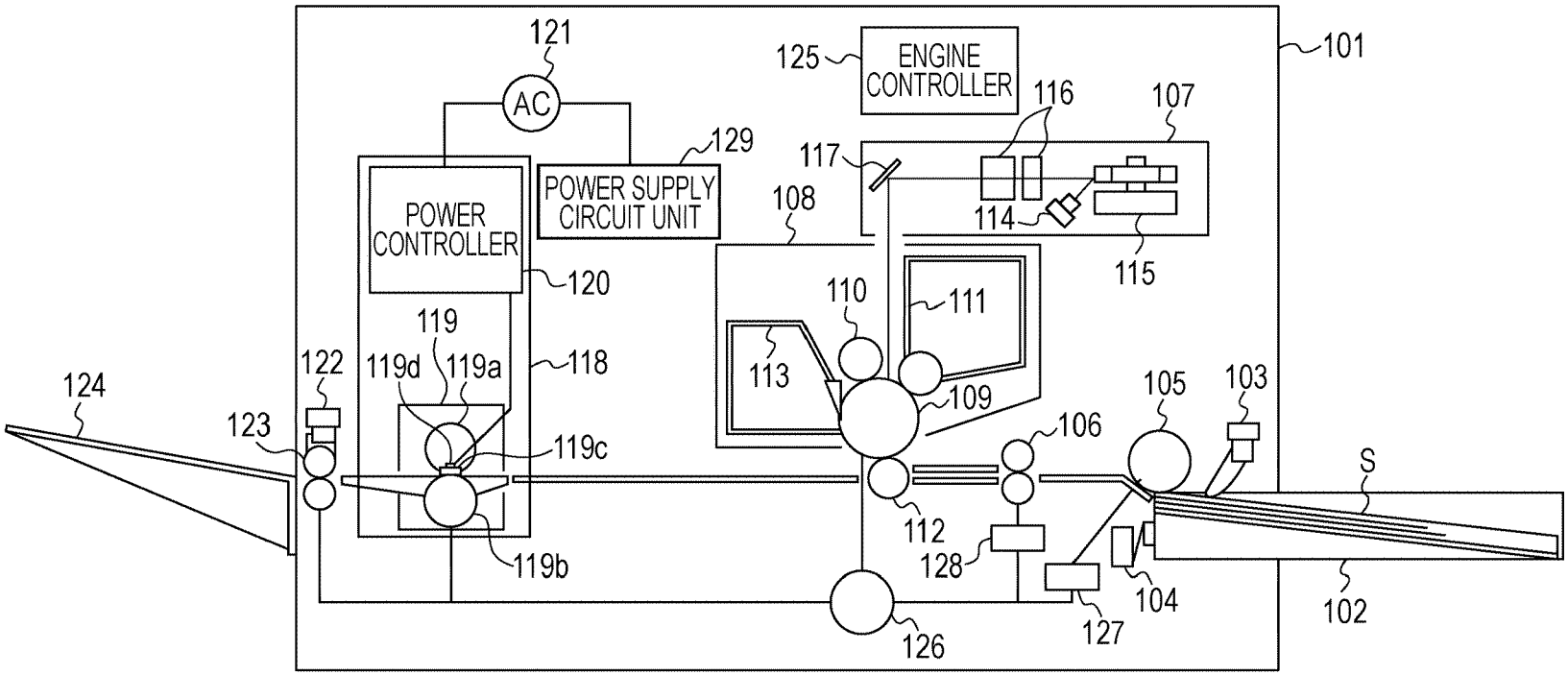
FIG. 1 is a diagram for describing the configuration of an image forming apparatus.

FIG. 1 is a schematic view of the configuration of an image forming apparatus (printer) which performs printing by using the electrophotographic recording technology. A printer main body 101 includes a cassette 102 storing a recording medium S. The printer main body 101 also includes a recording-medium detecting sensor 103 which detects the presence of the recording medium S in the cassette 102, and a size sensor 104 which detects the size of the recording medium S stored in the cassette 102. The printer main body 101 further includes a feeding roller 105 which feeds the recording medium S from the cassette 102. A registration roller pair 106 which adjusts the conveyance starting timing for the recording medium S is provided downstream of the feeding roller 105 in the direction in which the recording medium S is conveyed.

An image forming unit 108 which forms a toner image on the recording medium S is provided downstream of the registration roller pair 106. The image forming unit 108 is constituted by a photoconductor drum 109, a charging roller 110, a developing unit 111, a transfer roller 112, a cleaner 113, and the like. A laser scanner unit 107 includes a laser beam source 114 which emits a laser beam modulated on the basis of an image signal. The laser scanner unit 107 also includes a motor 115 which rotates a polygonal mirror for scanning the surface of the photoconductor drum 109 by using the laser beam emitted from the laser beam source 114, imaging lenses 116, and a mirror 117.

A fixing device (fixing apparatus) 118 which thermally fixes a toner image formed on the recording medium S, onto the recording medium S is provided downstream of the image forming unit 108. The fixing device 118 includes a fixing unit 119 and a power controller 120. The fixing unit 119 includes a fixing film 119*a*, a pressure roller 119*b*, a heater 119*c*, and a temperature detecting element (such as a thermistor) 119*d* which detects the temperature of the surface of the heater 119*c*. The heater 119*c* in this example is a ceramic heater in which heating elements are printed on a ceramic substrate. The heater 119*c* generates heat by using power supplied though the power controller 120, and supplies the heat to a toner image formed on the recording medium S which passes through the fixing unit 119. The power controller 120 is connected to a commercial alternating-current power source 121, and controls power supplied from the commercial alternating-current power source 121 to the heater 119*c*.

A sheet discharge sensor 122 which detects the condition of conveyance of the recording medium S, a discharge roller 123 which discharges the recording medium S, and a loading tray 124 on which the recording medium S having been subjected to recording is stacked are provided downstream of the fixing device 118. The recording medium S is conveyed so that the center of the recording medium S in the direction orthogonal to the direction in which the recording medium S is conveyed (the width direction of the recording medium S) moves in accordance with the conveyance reference for the recording medium S.

An engine controller (controller) 125 controls the laser scanner unit 107, the image forming unit 108, the fixing device 118, conveying rollers for the recording medium S in the printer main body 101, and the like. A main motor 126 provides driving force to the feeding roller 105 via a clutch 127 and to the registration roller pair 106 via a clutch 128. The main motor 126 also provides driving force to the units in the image forming unit 108, the fixing unit 119, the discharge roller 123, and the like.

A power supply circuit unit 129 generates a direct current voltage by performing switching control on an internal circuit by using power supplied from the commercial alternating-current power source 121, and supplies power to all pieces of electrical equipment in the printer main body excluding the heater 119*c*.

Figure 2:
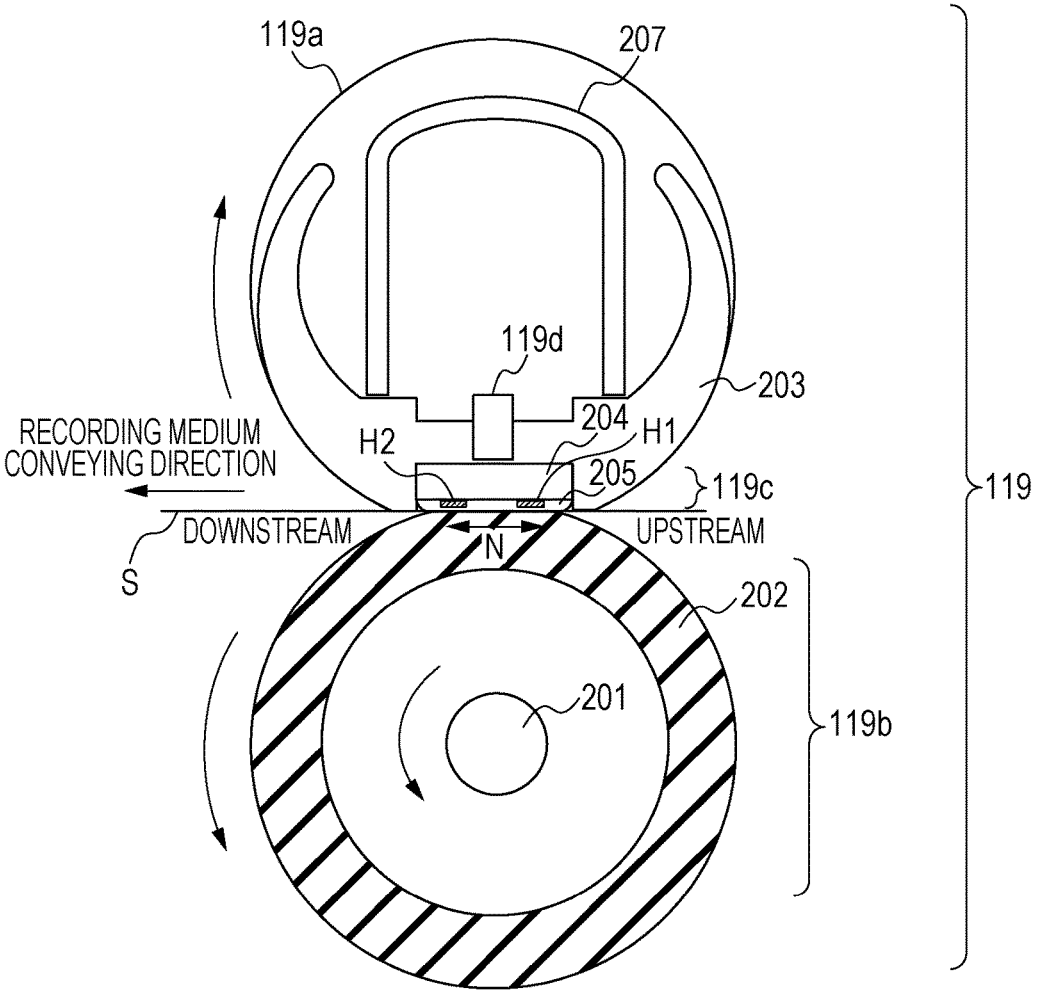
FIG. 2 is a sectional view of a fixing apparatus.

FIG. 2 is a sectional view of the fixing unit 119. The fixing unit 119 includes the cylindrical film 119*a*, the heater 119*c* which is in contact with the inner surface of the film 119*a*, and the pressure roller 119*b* which cooperates with the heater 119*c* via the film 119*a* to form a fixing nip portion N. The film 119*a* includes a base layer formed from high-temperature resin such as polyimide or metal such as stainless steel, a rubber layer formed from silicone rubber or the like, and a release layer formed from resin such as fluorocarbon polymer.

The pressure roller 119*b* includes a core metal 201 formed from iron, aluminum, or the like, and a rubber layer 202 formed from silicone rubber or the like.

The heater 119*c* is held by a holding member 203 made from high-temperature resin. The holding member 203 also has a guidance function of guiding rotation of the film 119*a*.

The pressure roller 119*b* rotates in the direction indicated by the arrow, by receiving power from the main motor 126. Rotation of the pressure roller 119*b* causes rotation of the film 119*a* to be driven.

The heater 119*c* includes a ceramic heater substrate 204, a first heating element H1 and a second heating element H2 which are printed on the substrate 204, and an insulating surface-protecting layer 205 (which is made from glass in the first embodiment) which covers the first heating element H1 and the second heating element H2. Heat produced by the first heating element H1 and the second heating element H2 causes an image formed on the recording medium S to be thermally fixed on the recording medium S. In a region in which paper of the minimum size available to the printer main body 101 passes through (in this example, the 110-mm width which is the size of an envelope), the temperature detecting element 119*d* is in contact with the back surface of the heater substrate 204. Power supplied from the commercial alternating-current power source 121 to the heating elements H1 and H2 is controlled in accordance with the detected temperature from the temperature detecting element 119*d* detecting the temperature of the heater 119*c*. The recording medium S holding a toner image is subjected to a thermal fixing process while being conveyed by using the fixing nip portion N pinching the recording medium S. A metal stay 207 reinforces the holding member 203, and pressure necessary to form the fixing nip portion N is applied between the stay 207 and the core metal 201.

Figure 3A:
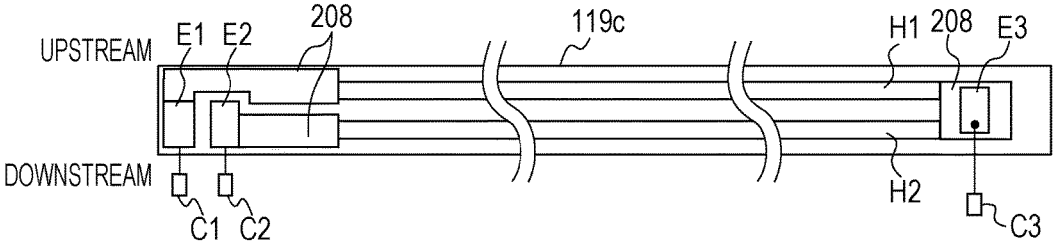
FIG. 3A is a plan view of a heater.
Figure 3B:
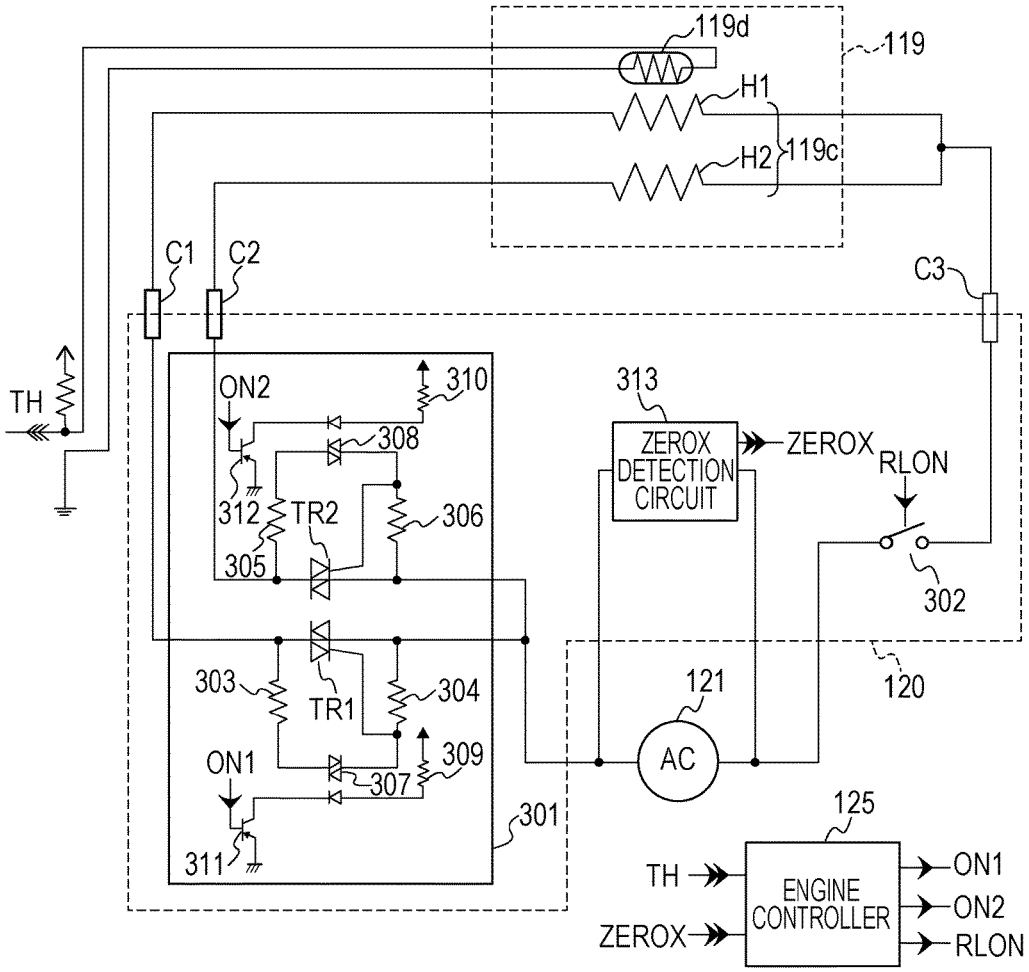
FIG. 3B is a circuit diagram for heater control.

FIG. 3A is a plan view of the heater 119*c*, and FIG. 3B is a circuit diagram of the power controller 120 connected to the heater 119*c*. Connectors C1, C2, and C3 on cables connect the heater 119*c* to the power controller 120. Electrodes E1, E2, and E3 on the heater are used to connect the connectors for power supply, and conducting patterns 208 are used to connect the electrodes to the heating elements. The commercial alternating-current power source 121 is connected to the power controller 120. Power supplied from the commercial alternating-current power source 121 is supplied to the first heating element H1 and the second heating element H2 via the driving circuit 301. The power supplied to the first heating element H1 and the second heating element H2 is adjusted by controlling a triac TR1 (first switching element) and a triac TR2 (second switching element) which are disposed in the driving circuit 301. The triac TR1 is disposed in a power supply path to the first heating element H1, and the triac TR2 is disposed in a power supply path to the second heating element H2. The triac TR1 and the triac TR2 are capable of being driven independently of each other. A relay 302 operates in accordance with an RLON signal transmitted from the engine controller 125.

Resistors 303 and 304 are bias resistors for the triac TR1, and resistors 305 and 306 are bias resistors for the triac TR2. Phototriac couplers 307 and 308 are devices for keeping a creepage distance between the primary side and the secondary side. When the light-emitting diode of the phototriac coupler 307 (308) is energized, the triac TR1 (TR2) is turned on. Resistors 309 and 310 are resistors for limiting currents through the phototriac couplers 307 and 308. Transistors 311 and 312 are elements for driving the phototriac couplers 307 and 308. The transistor 311 operates in accordance with an ON1 signal from the engine controller 125, and the transistor 312 operates in accordance with an ON2 signal from the engine controller 125.

A zero-cross detection circuit 313 notifies the engine controller 125 of a pulse signal indicating that the voltage of the commercial alternating-current power source 121 is equal to or larger than a threshold voltage. Hereinafter, a signal transmitted from the zero-cross detection circuit to the engine controller 125 is called a ZEROX signal. The engine controller 125 detects an edge of the pulse in the ZEROX signal, and transmits the ON1 signal and the ON2 signal by using the edge as a trigger.

The engine controller 125 receives a TH signal via the temperature detecting element 119*d*. The engine controller 125 performs an internal process in which the detected temperature corresponding to the TH signal is compared with a control target temperature which is preset. The power level to be supplied to the first heating element H1 and the second heating element H2 is obtained (calculated) in accordance with the comparison result. The engine controller 125 converts the obtained power level into a phase angle and/or a wave number, and outputs the ON1 signal and the ON2 signal.

A table as illustrated as Table 1 is set in the engine controller 125. When phase control in which a current flows in a part of a half cycle of alternating current is to be performed, the engine controller 125 outputs the ON1 signal and the ON2 signal on the basis of the table.

When wave number control in which current flows or does not flow over a half cycle of alternating current is to be performed, control is performed by using binary data of full-wave conduction (duty ratio of 100%) and current interruption (duty ratio of 0%).

TABLE 1

| Power level (duty ratio D (%)) | Phase angle α (°) |
|---|---|
| 100 | 0 |
| 97.5 | 28.56 |
| . . . | . . . |
| 75 | 66.17 |
| . . . | . . . |
| 50 | 90 |
| . . . | . . . |
| 60 | 80.93 |
| . . . | . . . |
| 25 | 113.83 |
| . . . | . . . |
| 2.5 | 151.44 |
| 0 | 180 |

Power supplied from the alternating-current power supply 121 to the first heating element H1 and the second heating element H2 is calculated for each control cycle which is a period corresponding to multiple predetermined cycles of an alternating current flowing from the alternating-current power supply 121, on the basis of the control target temperature and the detected temperature. In this example, a PI control (proportional+integral control) which is a type of feedback control is used to calculate a power level (duty ratio). The engine controller 125 uses phase control and wave number control which are described below, to control the waveforms of alternating currents flowing to the heating elements H1 and H2 so that power supplied to the heating elements H1 and H2 matches the calculated power level.

As illustrated in Table 1, phase control enables various levels of power to be supplied in a period corresponding to a half cycle of alternating current. Therefore, the amount of power supply per unit time is made uniform, which produces an advantage in terms of flicker. In contrast, since a current starts flowing in the middle of an alternating-current waveform (that is, the waveform of a sinusoidal wave is distorted), a harmonic current is produced.

To perform wave number control, binary data of full-wave conduction (duty ratio of 100%) and current interruption (duty ratio of 0%) is used. Therefore, it is difficult to make the amount of power supply per unit time uniform, which produces a disadvantage in terms of flicker compared with phase control. In contrast, since the waveform of a sinusoidal wave is not distorted, wave number control has an advantage that a harmonic current is hardly produced.

Figure 4:
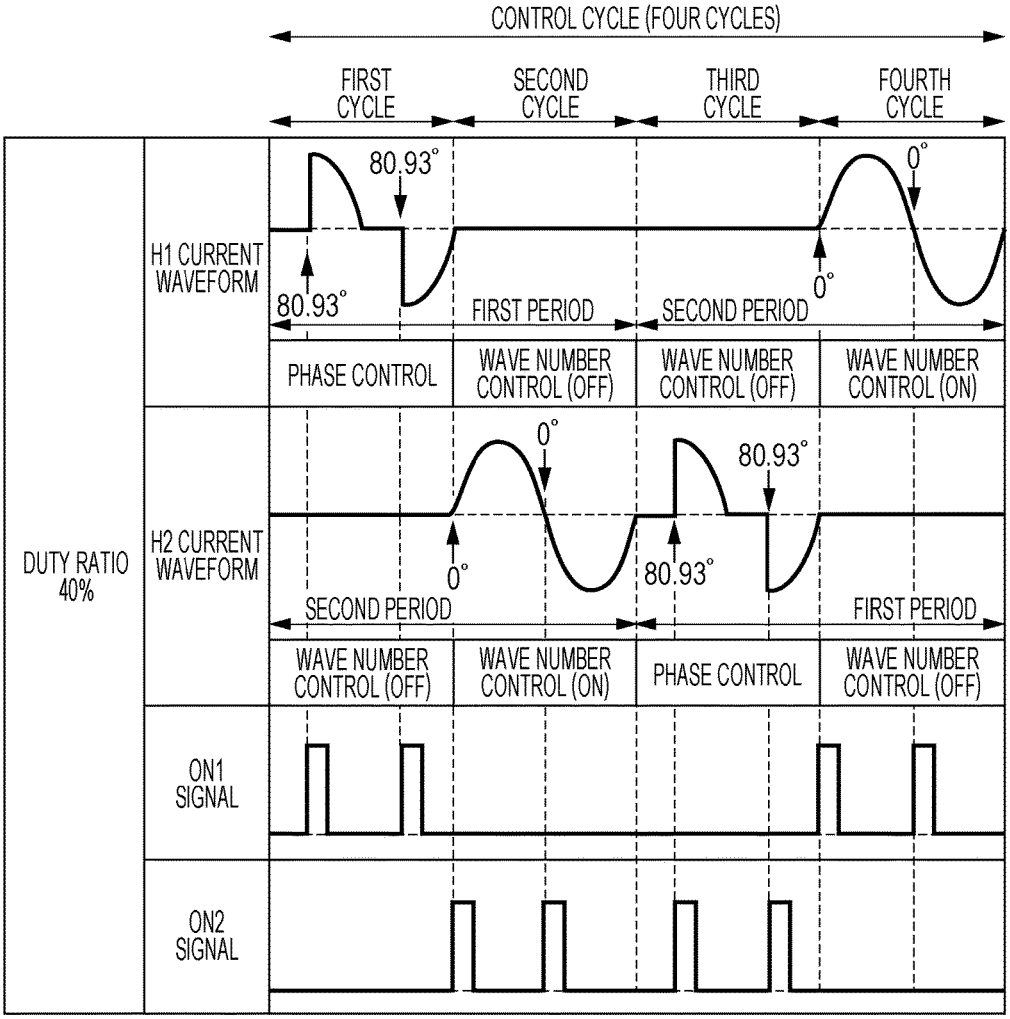
FIG. 4 is a diagram for describing current waveforms according to a first embodiment.
Figure 5A:
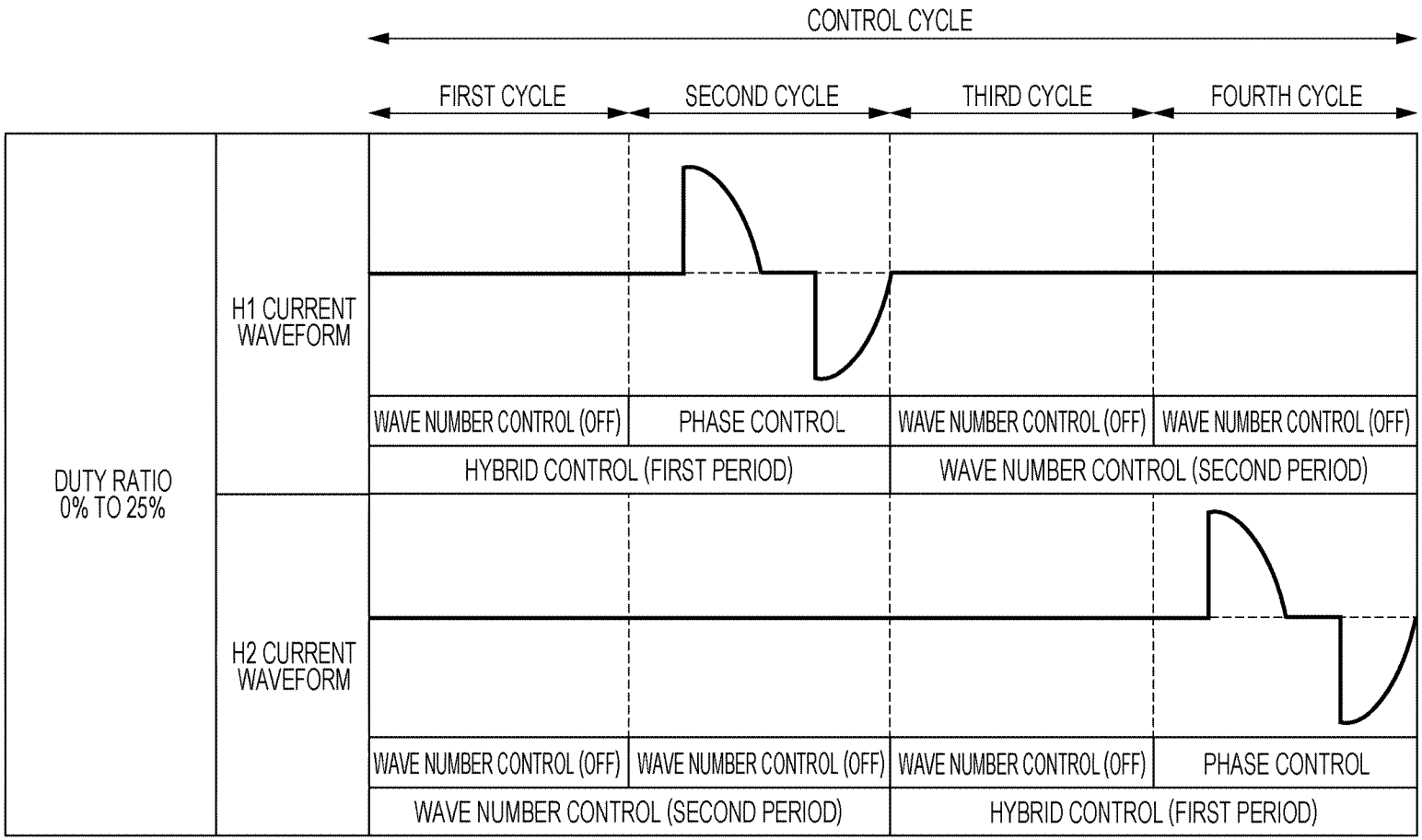
FIGS. 5A to 5D are diagrams illustrating current waveform tables according to the first embodiment.
Figure 5B:
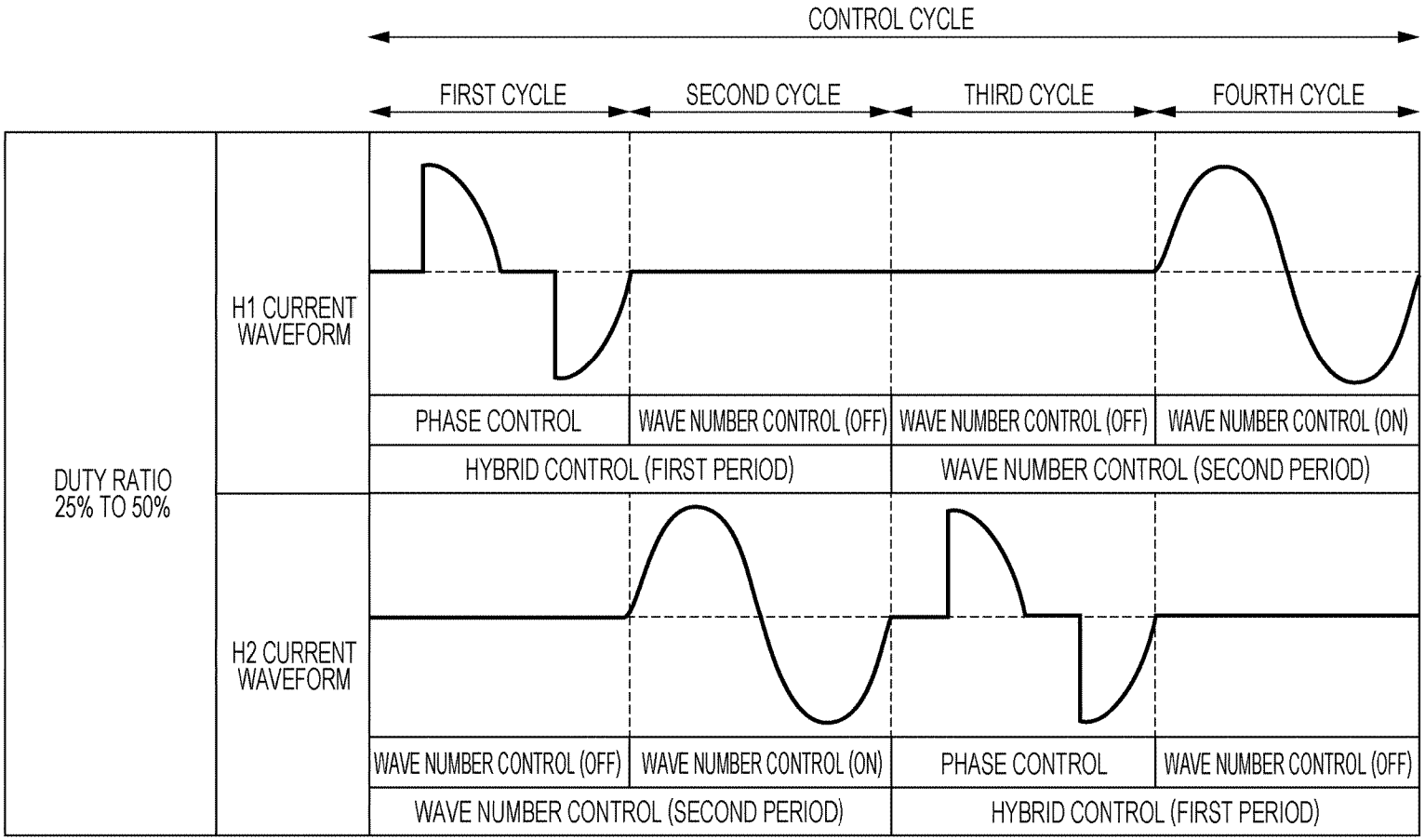
Figure 5C:
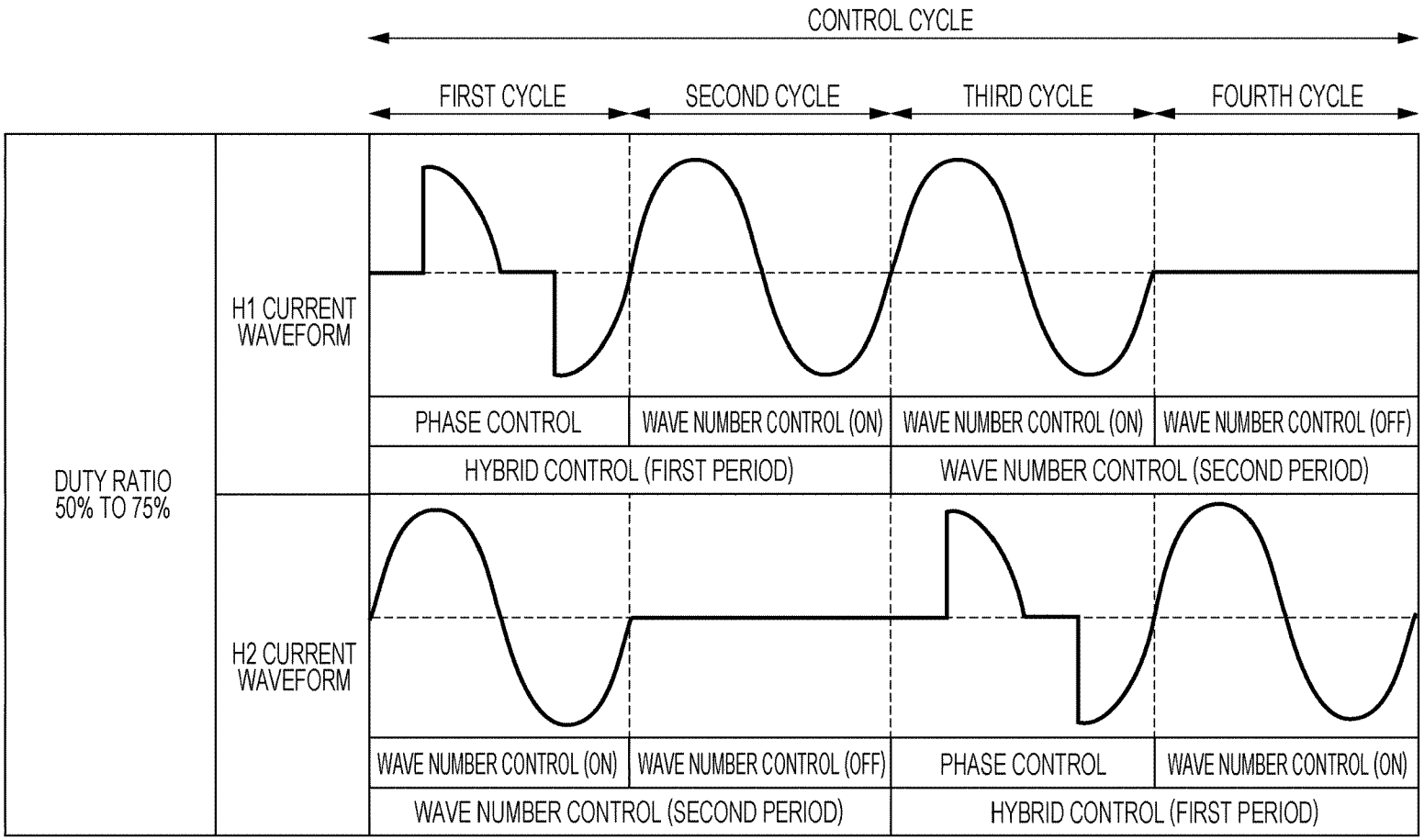
Figure 5D:
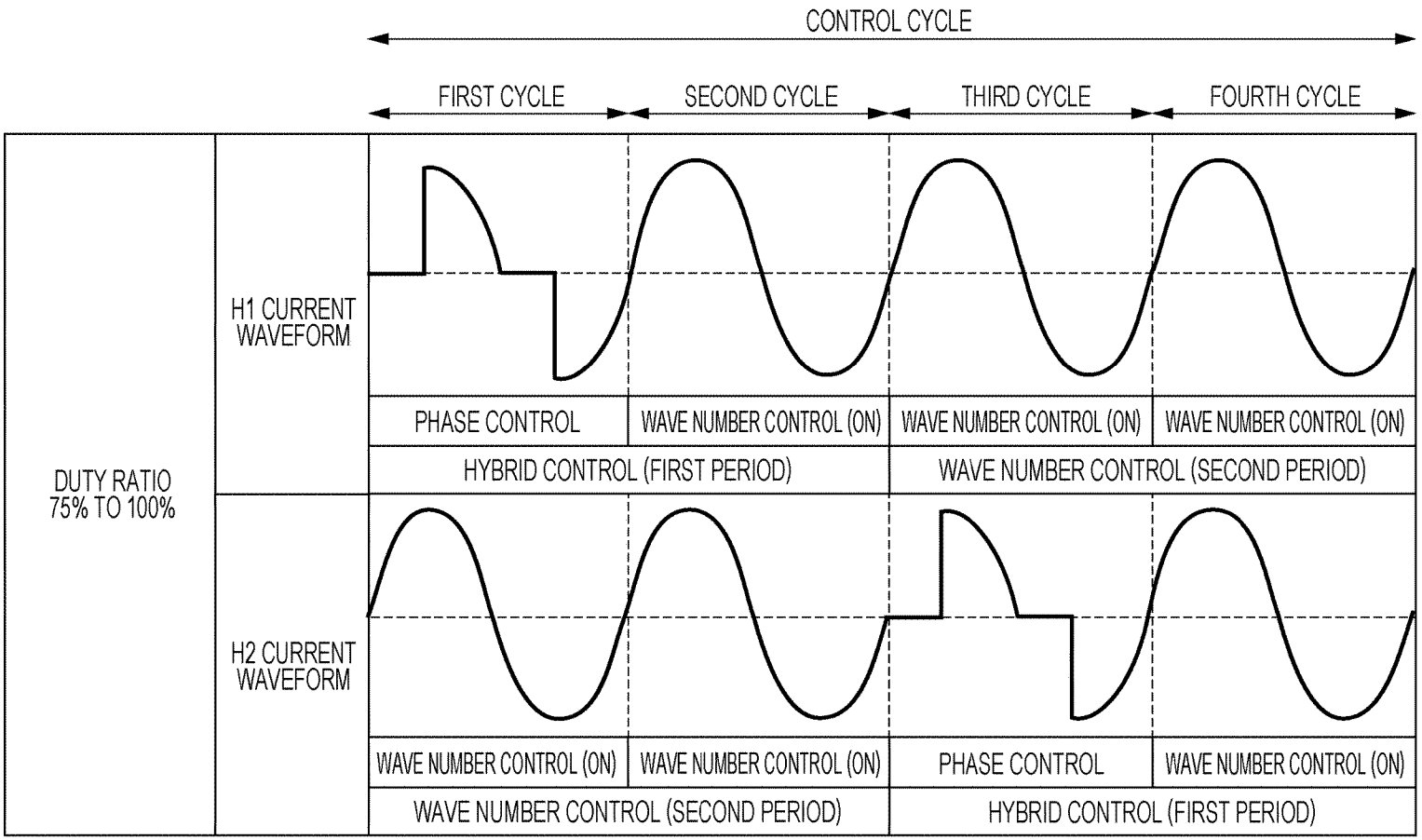

FIG. 4 is a diagram illustrating a relationship between the waveform of a current flowing through the heating element H1 and the ON1 signal and a relationship between the waveform of a current flowing through the heating element H2 and the ON2 signal. The relationships are produced when currents in which both of a phase control waveform and a wave-number control waveform are present flow through the heating elements. The waveform of a current in which both of a phase control waveform and a wave-number control waveform are present is referred to as a hybrid control waveform. FIG. 4 illustrates the waveforms of currents flowing through the heating elements H1 and H2 when power having a duty ratio of 40% is supplied to the heating elements H1 and H2. The H1 current waveform shows the waveform of a current flowing through the heating element H1 by driving the triac TR1, and the H2 current waveform shows the waveform of a current flowing through the heating element H2 by driving the triac TR2. In the example in FIG. 4, four full waves (four cycles) of an alternating current flowing from the commercial alternating-current power source 121 constitute a control cycle.

When the duty ratio (power level) D of the total of power supplied to the heating element H1 and power supplied to the heating element H2 is 40%, the engine controller 125 outputs the ON1 signal and the ON2 signal so that the duty ratio D is 40% in the four-full-wave period. In FIG. 4, phase control is used for the first cycle of alternating current so that power having a duty ratio of 60% is supplied to the first heating element H1. As illustrated in Table 1, the phase angle α for a duty ratio of 60% is 80.93°. Therefore, in the first cycle, the ON1 signal is raised so that the phase angle α is 80.93°. When the ON1 signal is raised, the triac TR1 goes into the conductive state, and conduction of the first heating element H1 is started. The triac TR1 is kept in the conductive state until the alternating current voltage becomes zero volt. In contrast, the ON2 signal stays LOW in the period of the first cycle, and the second heating element H2 does not generate heat.

In the period of the second cycle of alternating current, the ON1 signal stays LOW. In contrast, to cause the second heating element H2 to perform full-wave conduction in the period of the second cycle, the ON2 signal is raised with a phase angle of 0°. The output timings of the ON1 signal in the third cycle and the fourth cycle are the same as those of the ON2 signal in the first cycle and the second cycle. Similarly, the output timings of the ON2 signal in the third cycle and the fourth cycle are the same as those of the ON1 signal in the first cycle and the second cycle. The duty ratio of power supplied to the first heating element H1 is 40% in the control time period, and the duty ratio of power supplied to the second heating element H2 is also 40% in the control time period. The duty ratio of the total of the power supplied to the first heating element H1 and the power supplied to the second heating element H2 is also 40%.

The engine controller (controller 125) in the example controls the first switching element TR1 and the second switching element TR2 so that three rules described below are satisfied.

The first rule is that, in both of the waveforms of alternating currents flowing through the first heating element H1 and the second heating element H2, a first period in which a hybrid control waveform appears and a second period in which only a wave-number control waveform appears alternately occur in the period of a control cycle.

The second rule is that, when the first heating element H1 operates in the first period, the second heating element H2 operates in the second period, and that, when the first heating element H1 operates in the second period, the second heating element H2 operates in the first period.

The third rule is that both of the waveform of an alternating current flowing through the first heating element H1 and that through the second heating element H2 are a waveform which is electrically symmetric in positive and negative directions, in the period of a control cycle.

FIG. 4 illustrates current waveforms formed in the case of a duty ratio of 40%. As illustrated in FIGS. 5A to 5D described below, waveforms satisfying the above-described three rules are set also for the other duty ratios in the waveform tables which are set in the controller 125. A waveform satisfying the three rules causes a reduction in the number of phase control waveforms in a composite waveform of a current flowing through the first heating element H1 and a current flowing through the second heating element H2, resulting in suppression of occurrence of harmonic current. Further, phase control waveforms, each of which produces power smaller than that for a wave-number control waveform, appear, not in a short period in a concentrated manner, but in a long period in a scattered manner, resulting in suppression of occurrence of flicker.

In this example, the duty ratio of power supply which is calculated by using PI control is determined by using the flowing Expression (1).

$$\text{Duty ratio } D = P \text{ control value} + I \text{ control value} \quad (1)$$

Duty ratios D are set, for example, at intervals of 1.25%. P control value in Expression (1) is a control value for proportional control, and is given by using the following Expression (2).

$$P \text{ control value} = Kp \times \Delta T \quad (2)$$

Kp is a proportional gain, and is set at an adequate value in consideration of an overshoot and temperature stability of heater temperature. In addition, ΔT is a difference between the control target temperature and the detected temperature, and is a value obtained by subtracting the present detected temperature from the control target temperature.

I control value in Expression (1) which is a control value for integral control corrects a drift from the integral value of ΔT produced over a predetermined period, that is, the control target temperature, and is given, as an offset, to the duty ratio D of power produced by P control.

FIGS. 5A to 5D illustrate waveform tables which are set in the engine controller 125. Each pair of the waveforms for the duty ratios of 0% to 100% satisfies the above-described three rules. In the range of duty ratio of 0% to 25%, when the phase angle for turning ON in the phase control waveform is changed, the duty ratio changes in a range of 25%. Similarly, in the range of duty ratio of 25% to 50%, the range of duty ratio of 50% to 75%, and the range of duty ratio of 75% to 100%, when the phase angle for turning ON in the phase control waveform is changed, the duty ratio changes in a range of 25%.

The waveforms are illustrated in FIGS. 5A to 5D in such a manner that, for all of the duty ratios, the waveform of a current flowing through the first heating element H1 in the first cycle and that in the second cycle are the same as the waveform of a current flowing through the second heating element H2 in the third cycle and that in the fourth cycle. The waveform of a current flowing through the first heating element H1 in the third cycle and that in the fourth cycle are the same as the waveform of a current flowing through the second heating element H2 in the first cycle and that in the second cycle. In other words, for all of the duty ratios, the waveform of a current flowing through the first heating element H1 in the first period (the period for the hybrid control waveform) is the same as the waveform of a current flowing through the second heating element H2 in the first period. The waveform of a current flowing through the first heating element H1 in the second period (the period for the wave-number control waveform) is also the same as the waveform of a current flowing through the second heating element H2 in the second period.

When, for the waveforms illustrated in FIGS. 5A to 5D, the total of currents flowing through the heating elements H1 and H2 per cycle is obtained and the totals for the four cycles are compared with each other, the differences are set so that each difference is equal to or less than a current value obtained by turning ON over one cycle period. That is, a waveform is set so that power is not supplied in a concentrated manner in one cycle among the four cycles. This is because, when power is supplied in a concentrated manner in one cycle, occurrence of flicker is hardly suppressed.

Figure 6A:
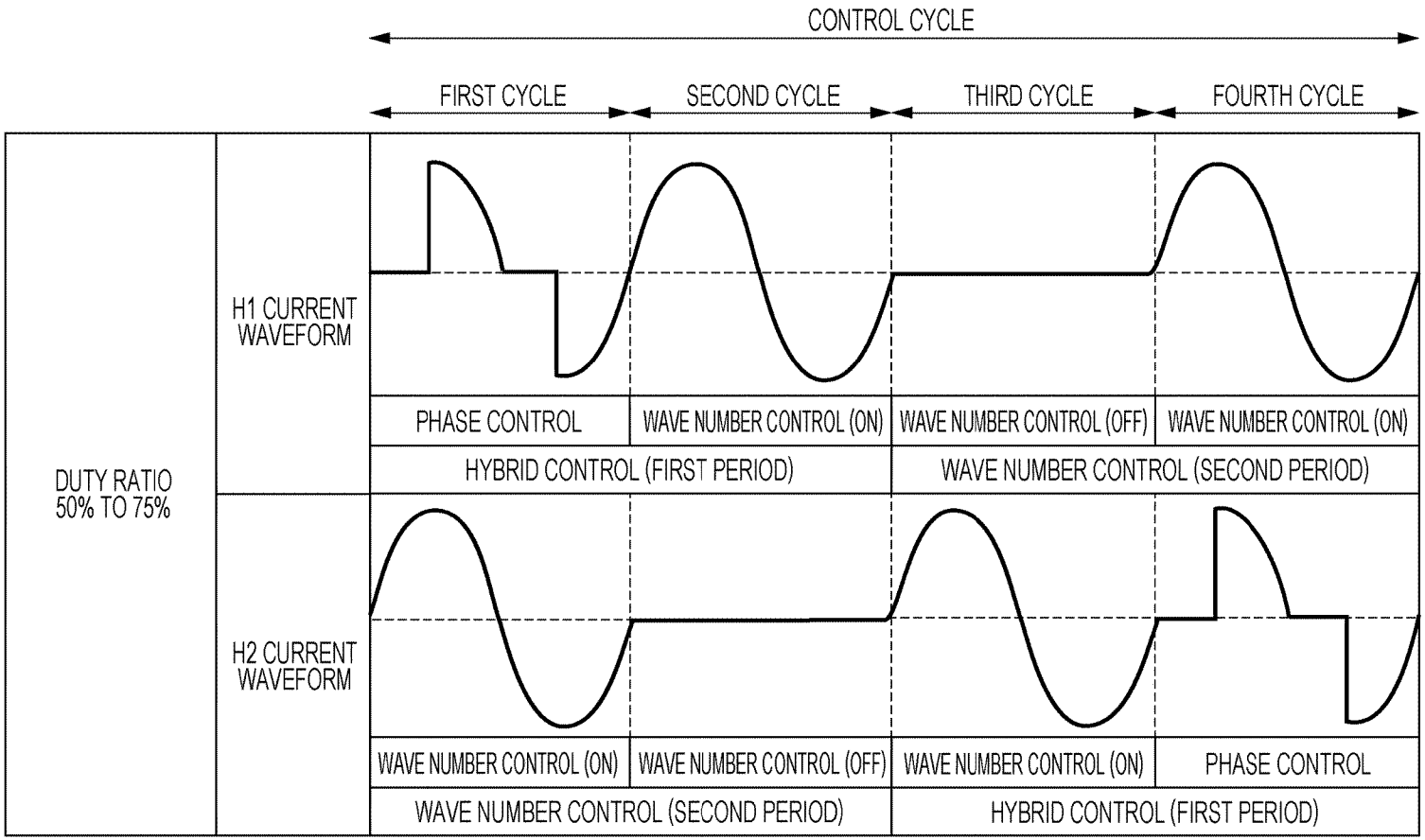
FIGS. 6A and 6B are diagrams illustrating modified examples of current waveforms according to the first embodiment.
Figure 6B:
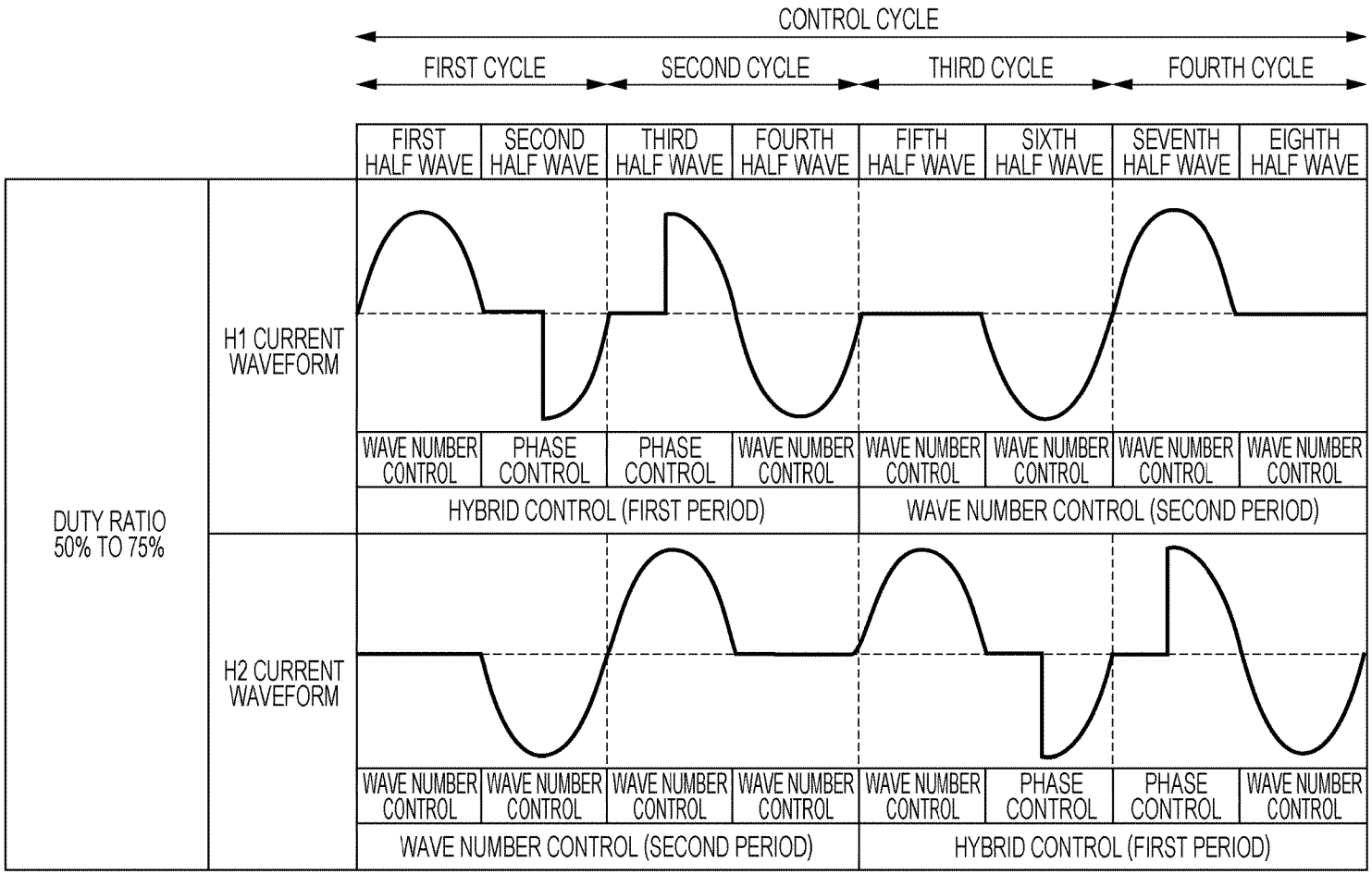

FIGS. 6A and 6B illustrate modified examples of the waveform tables illustrated in FIGS. 5A to 5D. A description will be made by taking a current waveform for the duty ratio of 50% to 75% as an example.

As described above, for all of the duty ratios, the waveforms illustrated in FIGS. 5A to 5D satisfy the first to third rules, and the waveform of a current flowing through the first heating element H1 in the first period is the same as the waveform of a current flowing through the second heating element H2 in the first period. The waveform of a current flowing through the first heating element H1 in the second period is also the same as the waveform of a current flowing through the second heating element H2 in the second period. In contrast, similarly to the waves in FIGS. 5A to 5D, for all of the duty ratios, the waveforms in FIG. 6A satisfy the first to third rules. However, the waveform of a current flowing through the first heating element H1 in the first period is not the same as the waveform of a current flowing through the second heating element H2 in the first period. The waveforms are different in that the order of the one-cycle waveforms in the latter waveform is the reverse order of that in the former waveform. Similarly, the order of the one-cycle waveforms in the waveform of a current flowing through the first heating element H1 in the second period is the reverse order of that in the waveform of a current flowing through the second heating element H2 in the second period. These waveforms may also cause occurrence of harmonic current and flicker to be suppressed.

Similarly to the waveforms in FIGS. 5A to 5D, for all of the duty ratios, the waveforms in FIG. 6B satisfy the first to third rules. Similarly to the waveforms in FIGS. 5A to 5D, the waveform of a current flowing through the first heating element H1 in the first period is the same as the waveform of a current flowing through the second heating element H2 in the first period. The waveform of a current flowing through the first heating element H1 in the second period is the same as the waveform of a current flowing through the second heating element H2 in the second period. However, the waveforms in FIG. 6B are different from those in FIGS. 5A to 5D in that, while the waveforms in FIGS. 5A to 5D are electrically symmetric in positive and negative directions in one cycle period, the waveforms in FIG. 6B are asymmetric, and are waveforms obtained by switching between phase control and wave number control at intervals of half wave. These waveforms also enable occurrence of harmonic current and flicker to be suppressed.

Second Embodiment

The waveforms illustrated in FIGS. 5A to 5D and 6A to 6B satisfy the first to third rules. A second embodiment will be described by using a waveform table illustrated in FIG. 7.

Figure 7:
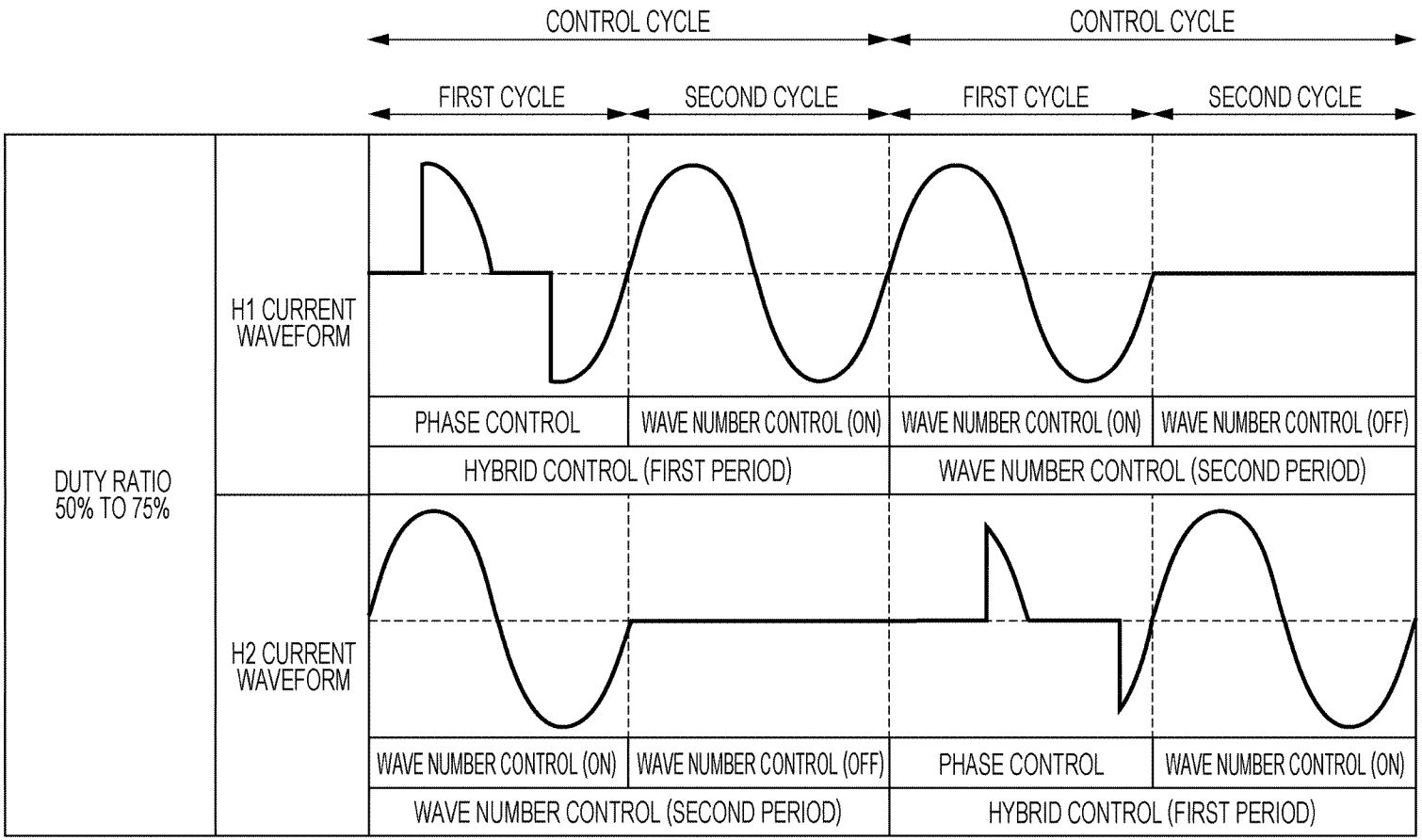
FIG. 7 is a diagram for describing current waveforms according to a second embodiment.
Figure 8A:
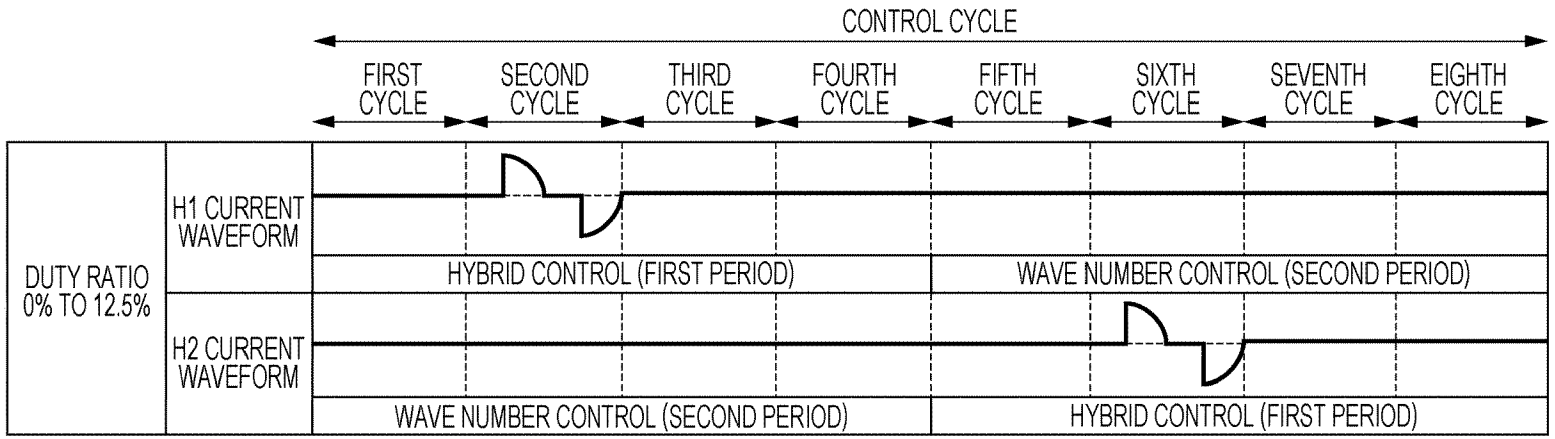
FIGS. 8A to 8H are diagrams illustrating current waveform tables according to a third embodiment.
Figure 8B:
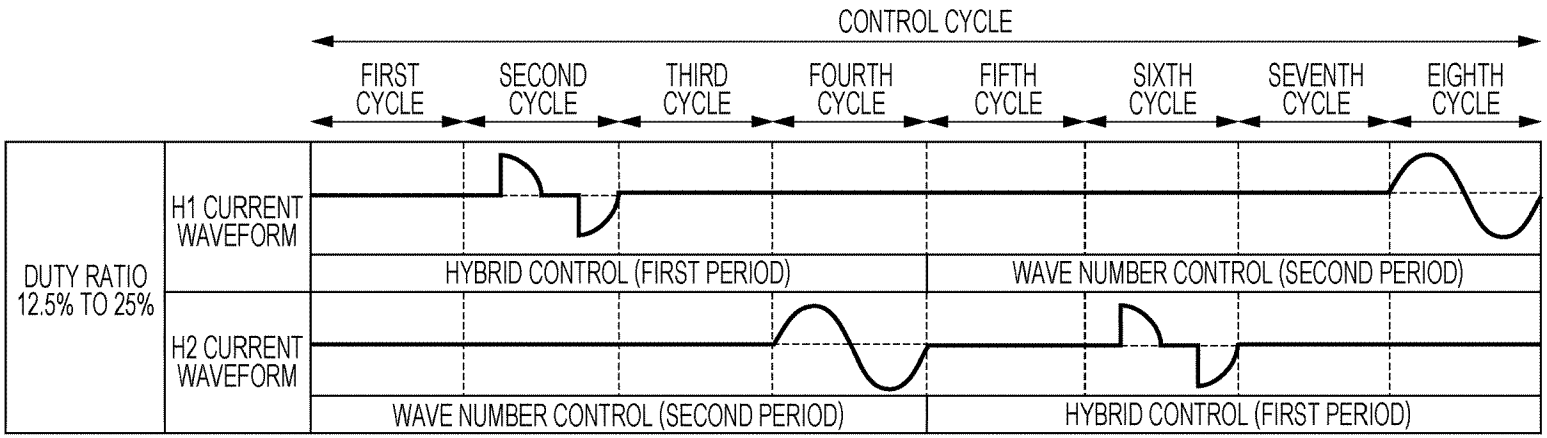
Figure 8C:
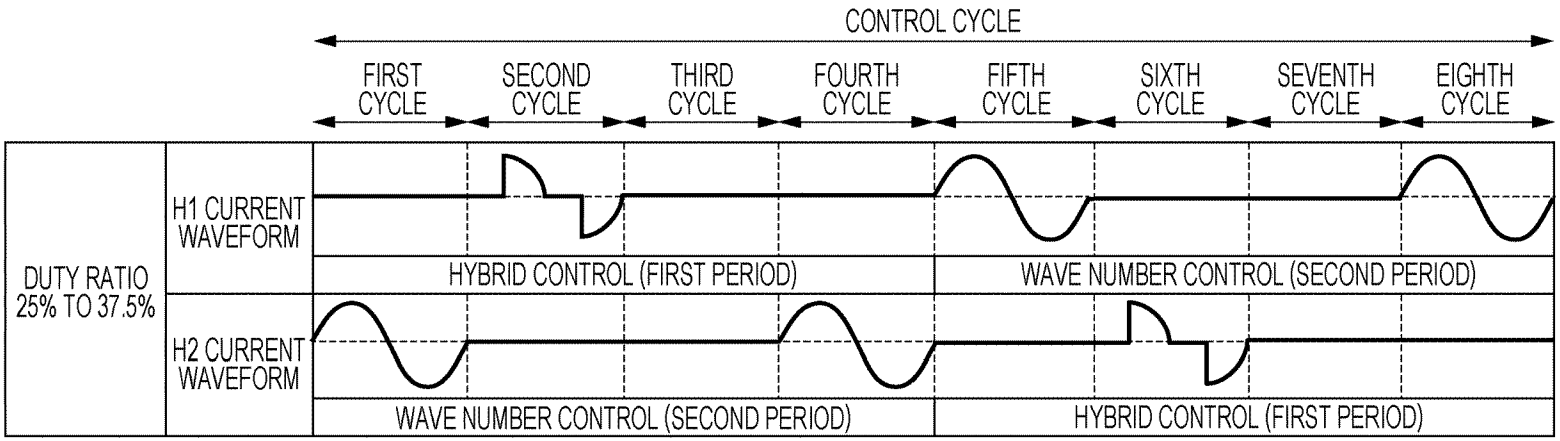
Figure 8D:
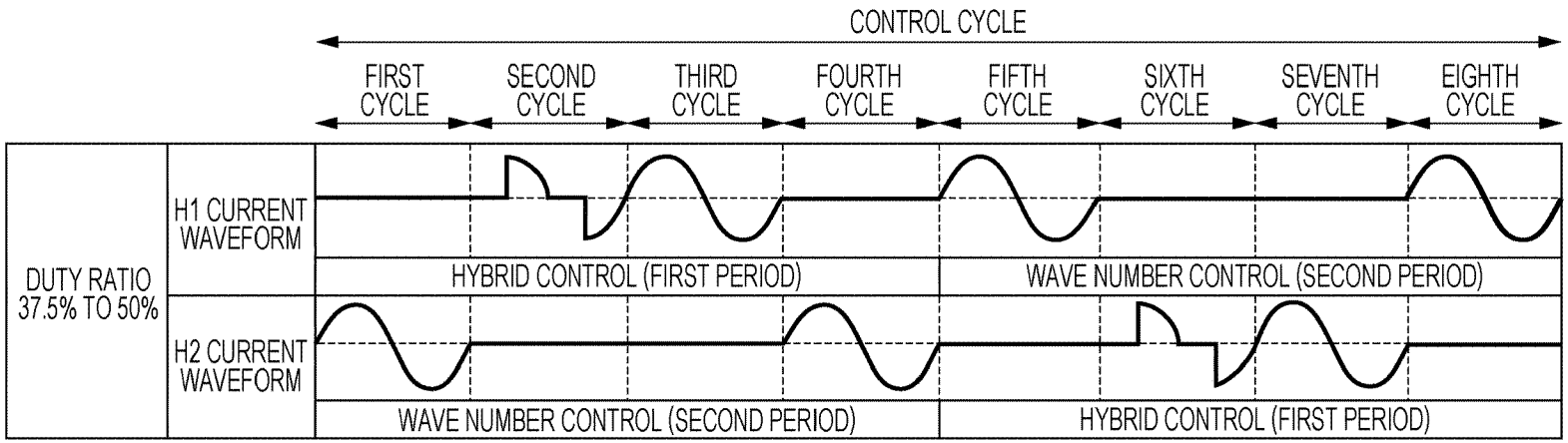
Figure 8E:
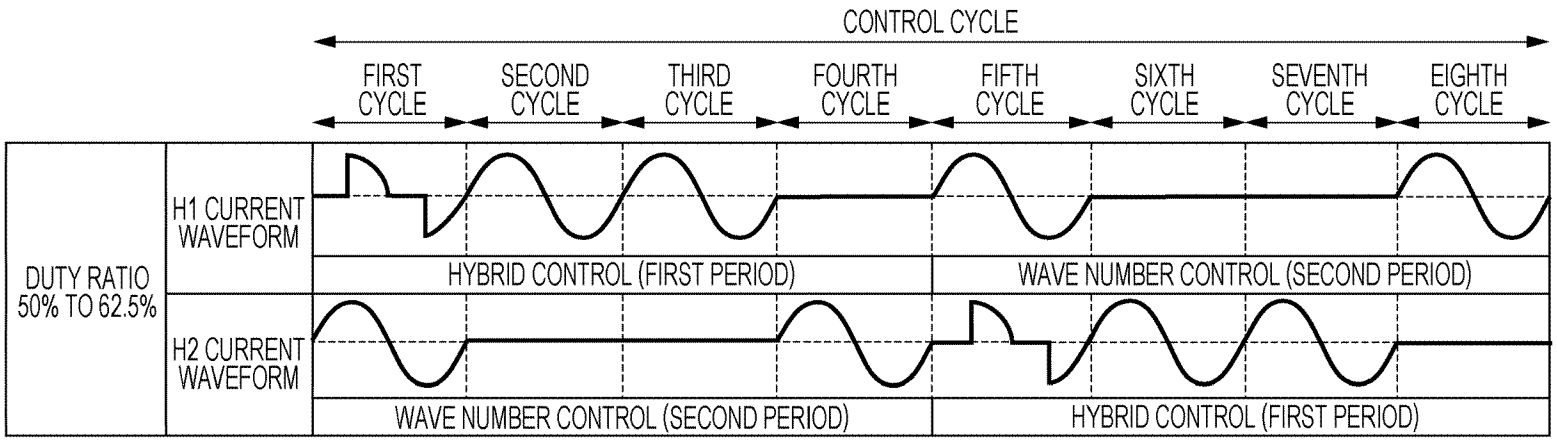
Figure 8F:
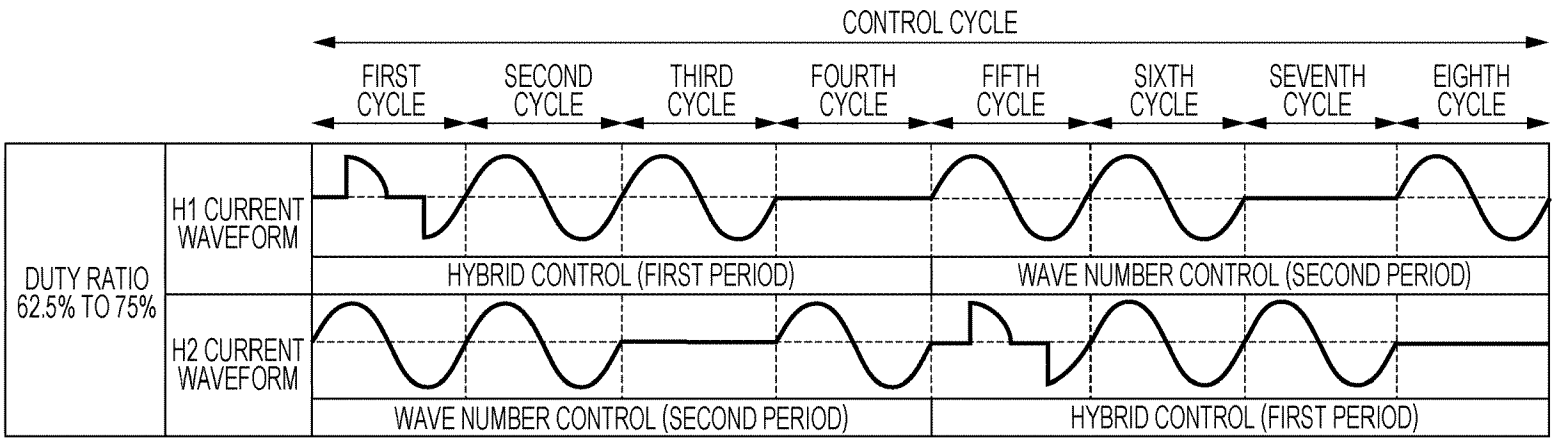
Figure 8G:
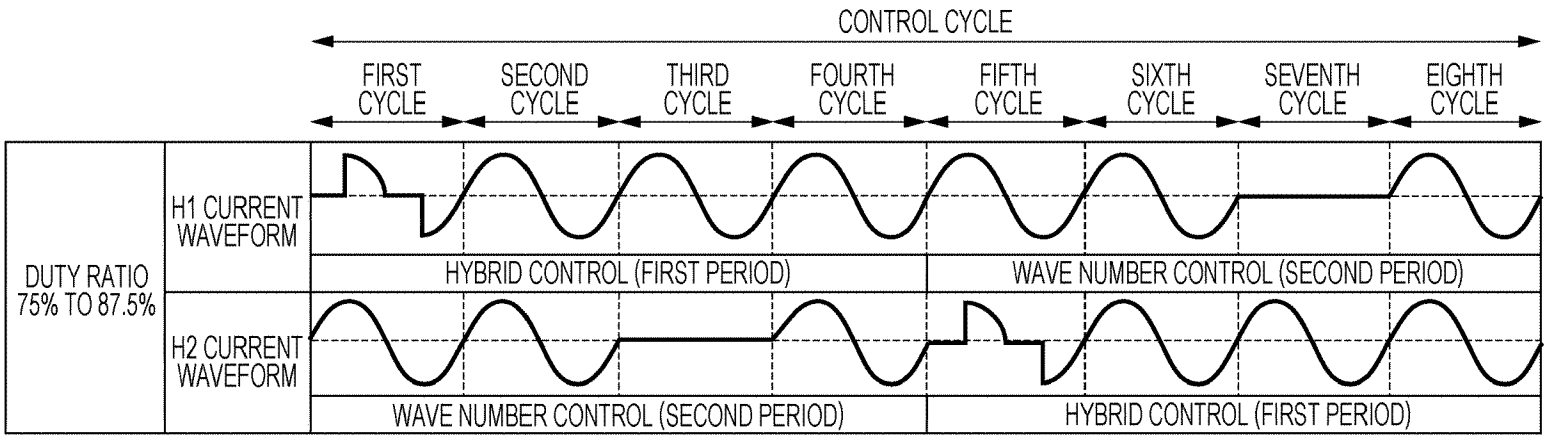
Figure 8H:
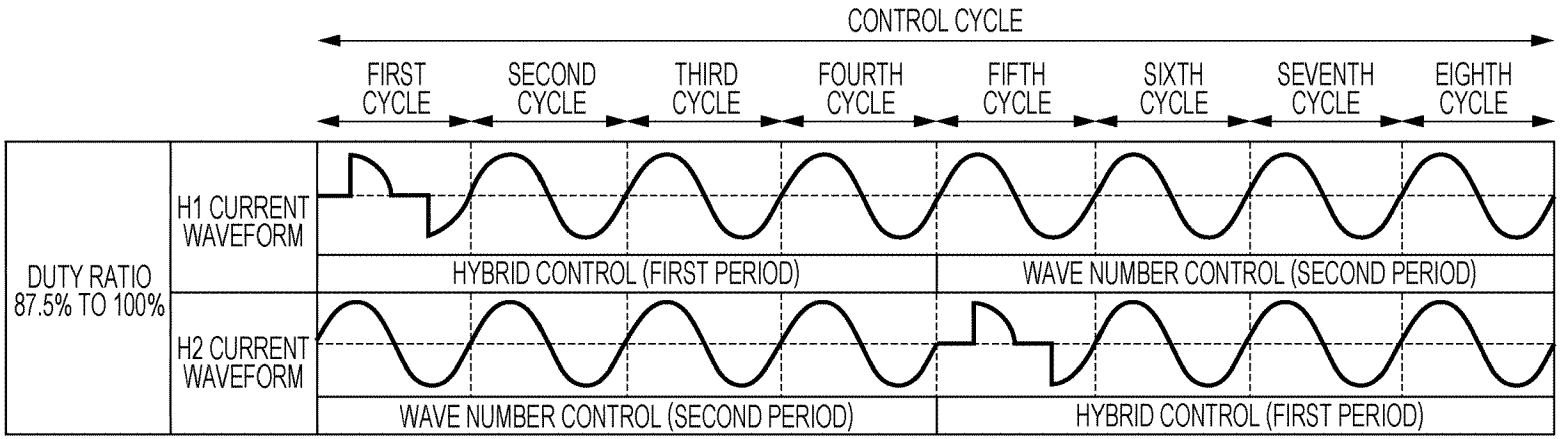

For the waveforms illustrated in FIG. 7, a control cycle has two cycles (two full waves) of alternating current. This waveform is such that, in both of the waveform of an alternating current flowing through the first heating element H1 and that through the second heating element H2, a first period in which a hybrid control waveform appears and a second period in which only a wave-number control waveform appears alternately occur in the period of two continuous control cycles (a modified rule of the first rule). When the first heating element H1 operates in the first period, the second heating element H2 operates in the second period. When the first heating element H1 operates in the second period, the second heating element H2 operates in the first period (the second rule). Both of the waveform of an alternating current flowing through the first heating element H1 and that through the second heating element H2 are electrically symmetric in positive and negative directions in the period of a control cycle (the third rule). Power supplied to the first heating element H1 and the second heating element H2 in the period of each control cycle corresponds to the detected temperature obtained from the temperature detecting element 119*d*. This waveform also enables occurrence of harmonic current and flicker to be suppressed.

Third Embodiment

FIGS. 8A to 8H illustrate waveform tables in which the waveforms illustrated in FIGS. 5A to 5D are changed by further decreasing the number of phase control operations. Similarly to the waveforms illustrated in FIGS. 5A to 5D, the waveforms illustrated in FIGS. 8A to 8H also satisfy the first to third rules. The waveforms in FIGS. 8A to 8H are different from those in FIGS. 5A to 5D in that a control cycle is constituted by eight cycles. In a waveform in FIGS. 8A to 8H, one phase control waveform appears for a current flowing through one heating element in the period of eight cycles, and the number of phase control waveforms is smaller than that in the waveforms in FIGS. 5A to 5D (two phase control waveforms appear in the period of eight cycles which includes two control cycles). Therefore, occurrence of harmonic current may be further suppressed.

By flowing a current in a waveform illustrated in FIGS. 5A to 8H, the number of phase control waveforms is decreased, and phase control waveforms appear in a scattered manner, achieving suppression of occurrence of harmonic current.

In the above-described examples, an apparatus in which two heating elements which are capable of being independently controlled are provided is described as an example. However, the above-described waveform rules may be applied to an apparatus in which three or more heating elements which are capable of being independently controlled are provided. When the number of heating elements are N and M heating elements among the N heating elements are hybrid-controlled, the wave number control may be performed on the remaining (N−M) heating elements at the same timings, and control may be switched in the period of a control cycle (or in the period of two control cycles).

Figure 9:
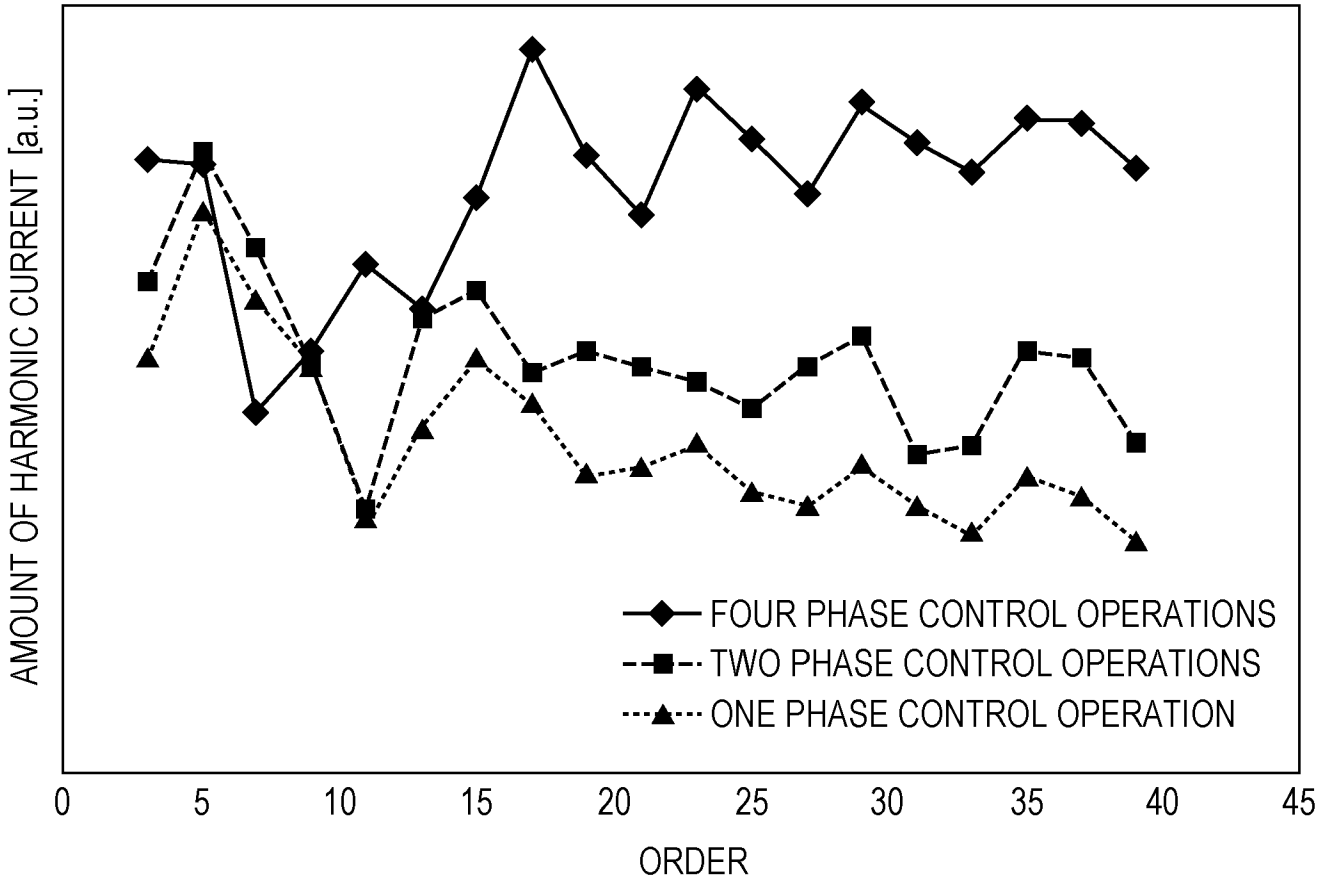
FIG. 9 is a diagram illustrating characteristics of harmonic current.
Figure 10A:
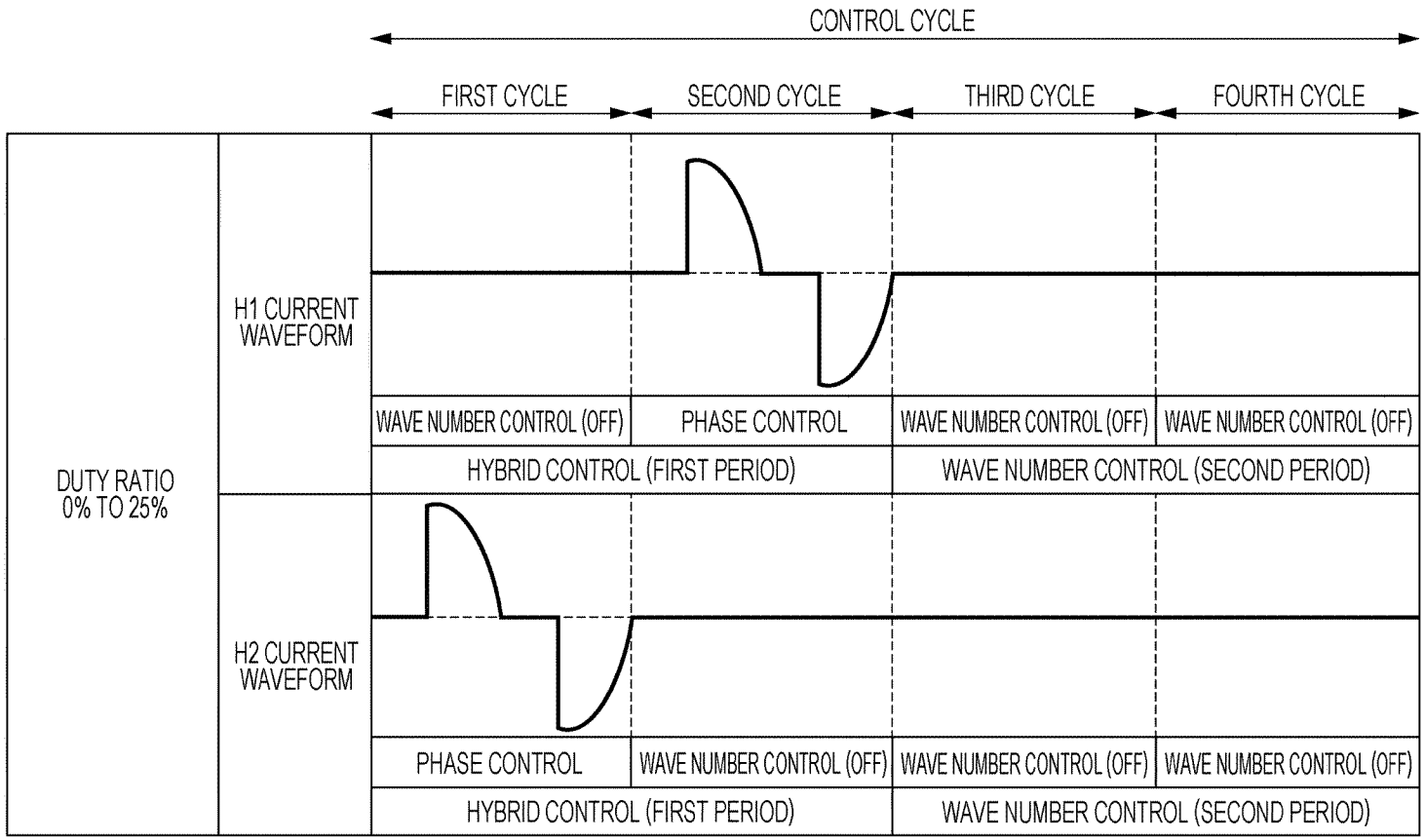
FIGS. 10A to 10D are diagrams illustrating current waveform tables of a comparative example.
Figure 10B:
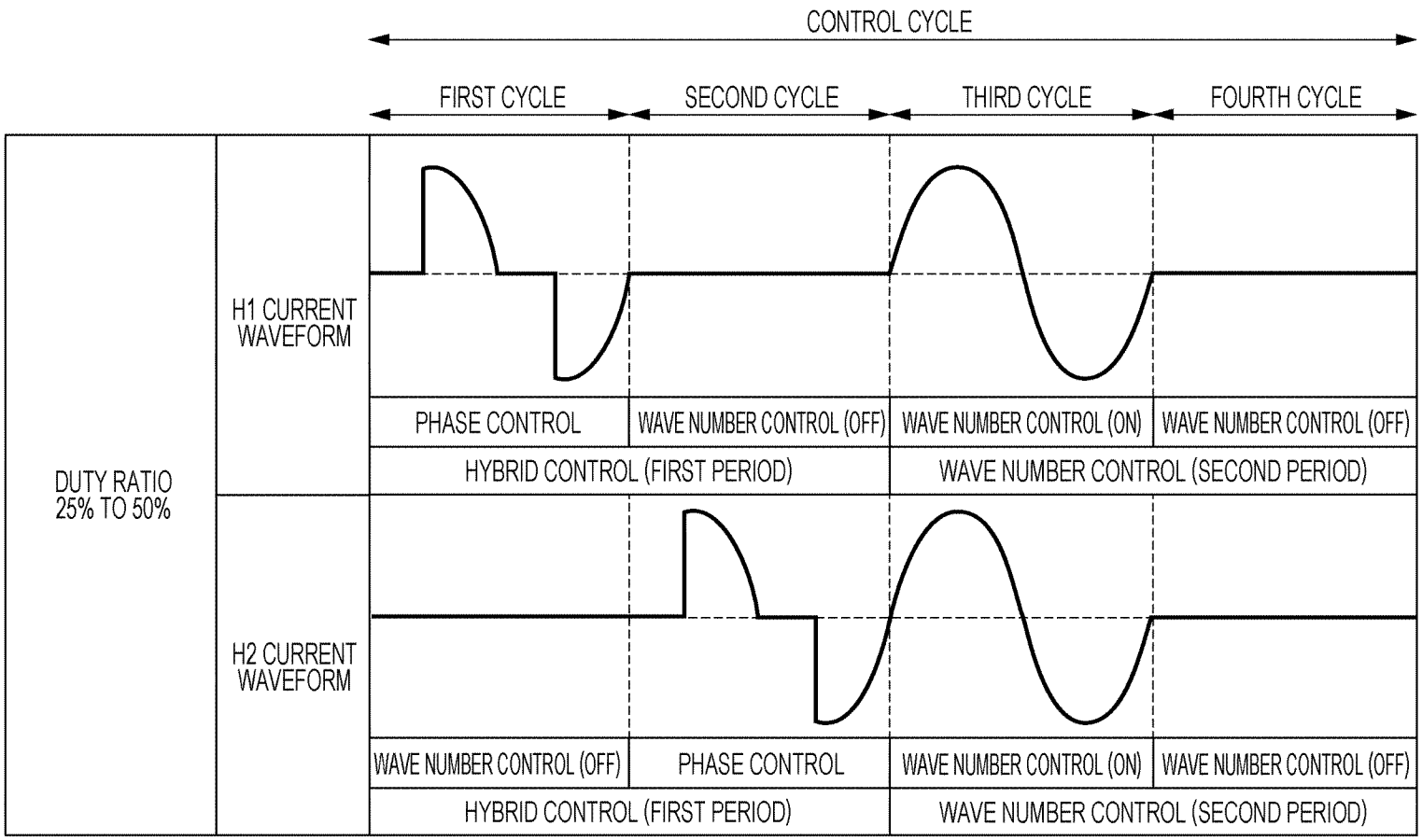
Figure 10C:
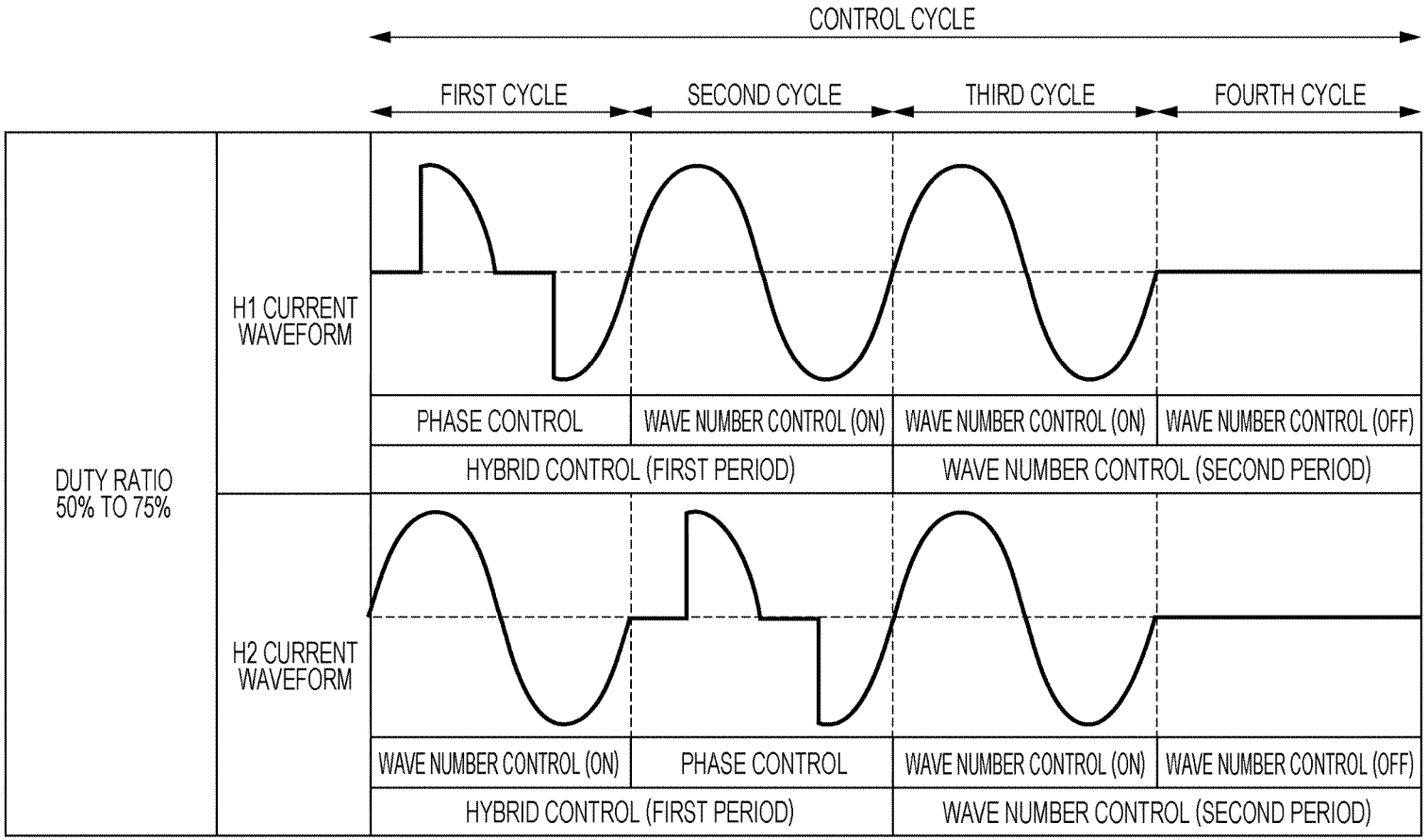
Figure 10D:
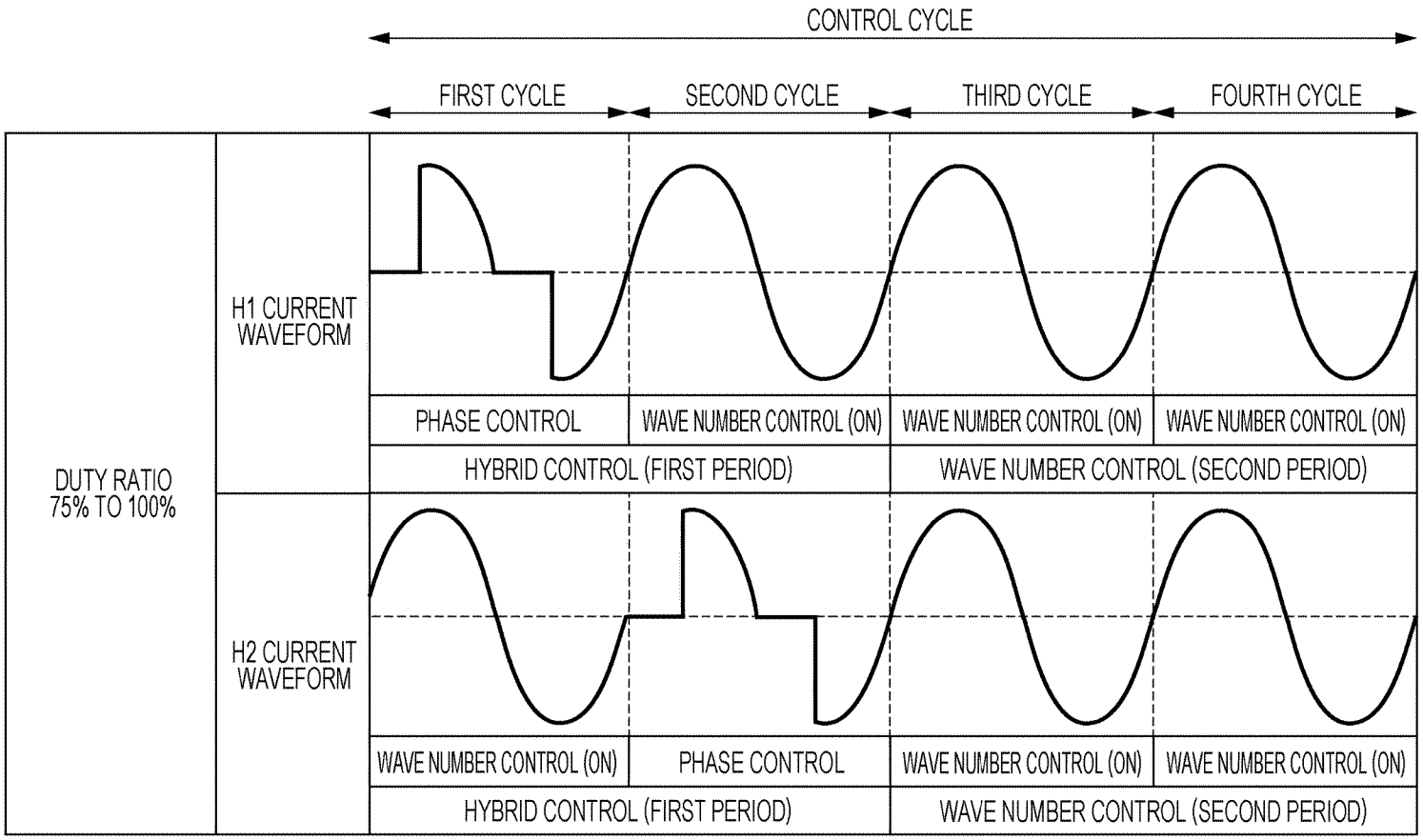

FIG. 9 is a diagram illustrating characteristics of the amount of a harmonic current for each order when the number of phase control operations is changed in four cycles of alternating current. The horizontal axis represents a harmonic order of the frequency of an alternating current flowing from the commercial alternating-current power source 121. The vertical axis represents the amount of a harmonic current. The case in which the number of phase control operations is two corresponds to the case in which the waveforms in FIGS. 5A to 5D are employed. The case in which the number of phase control operations is one corresponds to the case in which the waveforms in FIGS. 8A to 8H are employed. Thus, it is found that the amount of a harmonic current may be reduced when the number of phase control operations performed in the period of a control cycle is decreased.

FIGS. 10A to 10D illustrate waveforms of a comparative example which do not satisfy the first rule (or the modified rule of the first rule), the second rule, and the third rule which are described above. The waveforms illustrated in FIGS. 10A to 10D satisfy the first and third rules for all of the duty ratios, but not the second rule. Therefore, in a composite waveform of a current flowing through the first heating element H1 and that through the second heating element H2, phase control waveforms appear in a concentrated manner in the first cycle and the second cycle, resulting in reduction in the effect of suppression of occurrence of flicker.

Fourth Embodiment

Figure 11A:
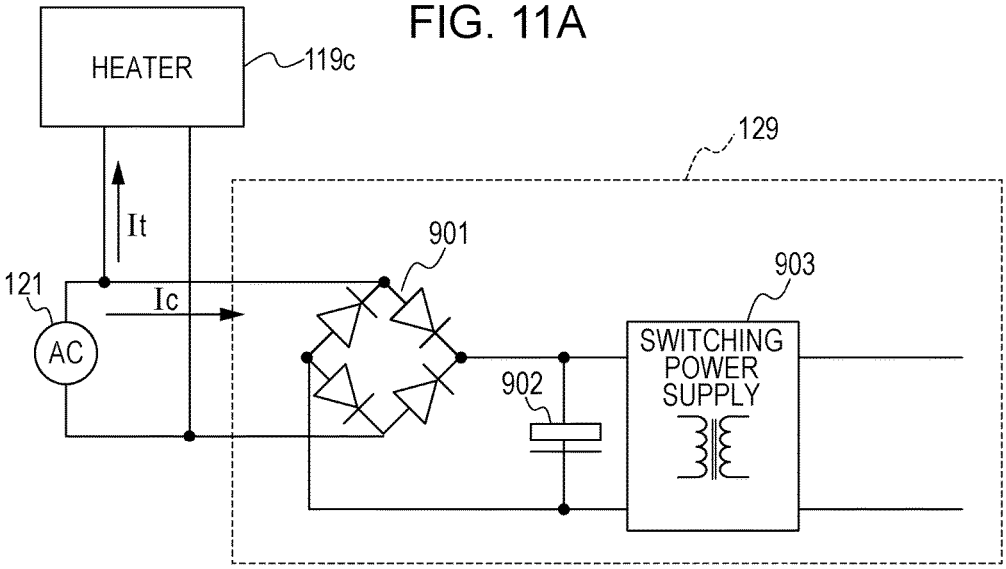
FIGS. 11A to 11C are diagrams illustrating the configuration of a power supply circuit unit.
Figure 11B:
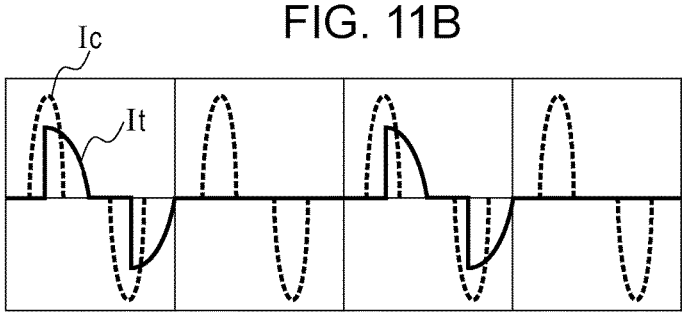
Figure 11C:
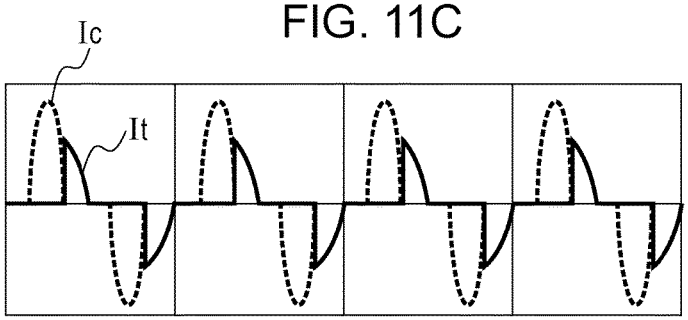

FIGS. 11A to 11C are diagrams illustrating a circuit for the power supply circuit unit 129, and composite currents of a current flowing through the power supply circuit unit 129 and that through the heater 119*c*.

FIG. 11A is a diagram illustrating the circuit configuration of the power supply circuit unit 129. The voltage of the commercial alternating-current power source 121 is input to a diode bridge 901. The alternating current voltage is subjected to full-wave rectification by the diode bridge 901, and is smoothed by a smoothing capacitor 902. The smoothed voltage is input to a switching power supply 903 which is a DC-DC converter, and the switching power supply 903 outputs a secondary-side voltage. As the switching power supply 903, an insulating transformer is used to achieve insulation between the primary side and the secondary side. The voltage generated by the power supply circuit unit 129 is used for a driving-system load such as a motor in a printer or a control system load such as a central processing unit (CPU).

FIG. 11B is a diagram illustrating a current Ic flowing to the power supply circuit unit 129 and a current It flowing to the heater 119*c*. The current Ic flowing to the power supply circuit unit 129 is illustrated by using a dotted line, and the current It flowing to the heater 119*c* is illustrated by using a solid line. In the first cycle and the third cycle of alternating current, the current It having a phase control waveform whose phase angle is 90° flows. The current Ic and the current It temporally overlaps each other near a phase angle of 90°. Thus, when the current Ic and the current It temporally overlap each other, the amount of a composite current of the current Ic and the current It is increased. Therefore, as a result, the power factor of the composite current of the current Ic and the current It has a tendency to become worse. When the power factor becomes worse, the amount of a current flowing to the heater 119*c* is decreased. As a result, the amount of power supplied to the heater 119*c* is decreased. When power which may be supplied in a period in which the heater 119*c* is warmed up until a temperature at which fixing operations may be successfully performed is reduced, the time required to make the fixing device enter a state in which fixing operations may be successfully performed is prolonged.

FIG. 11C is also a diagram illustrating the current Ic flowing to the power supply circuit unit 129 and the current It flowing to the heater 119*c*. In all of the first to fourth cycles, the current It which has been subjected to phase control flows through the heater 119*c*. The total current amount of the current It in FIG. 11C is the same as that of the current It in FIG. 11B. By increasing the number of phase control operations, each phase control waveform is made small (a conduction angle is made small). By making a phase control waveform small, a temporal overlap between the current Ic and the current It near the phase angle 90° in the current waveform in FIG. 11C is smaller than that in the waveform in FIG. 11B. Thus, when the current Ic and the current It do not temporally overlap each other, the power factor of a composite current of the current Ic and the current It has a tendency to become better. That is, as illustrated in FIG. 11C, by increasing the number of phase control operations, a region in which a temporal overlap appears is reduced, resulting in an increase in the power factor. However, since the number of phase control operations is increased in the period of a control cycle, harmonic current is aggravated.

Therefore, the waveform tables in this example are tables obtained in consideration with not only harmonic current and flicker but also a power factor.

Figure 12A:
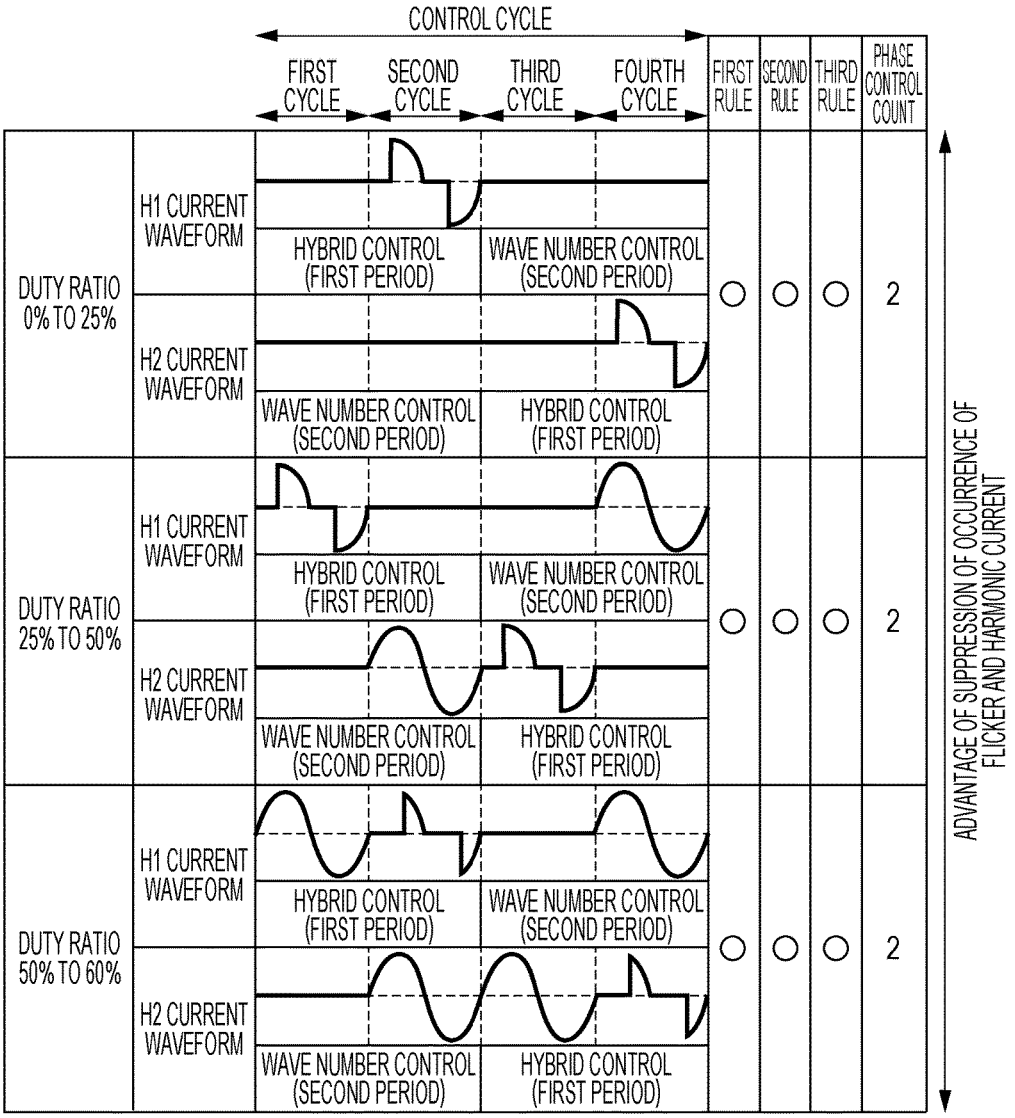
FIGS. 12A and 12B are diagrams illustrating current waveform tables according to a fourth embodiment.
Figure 12B:
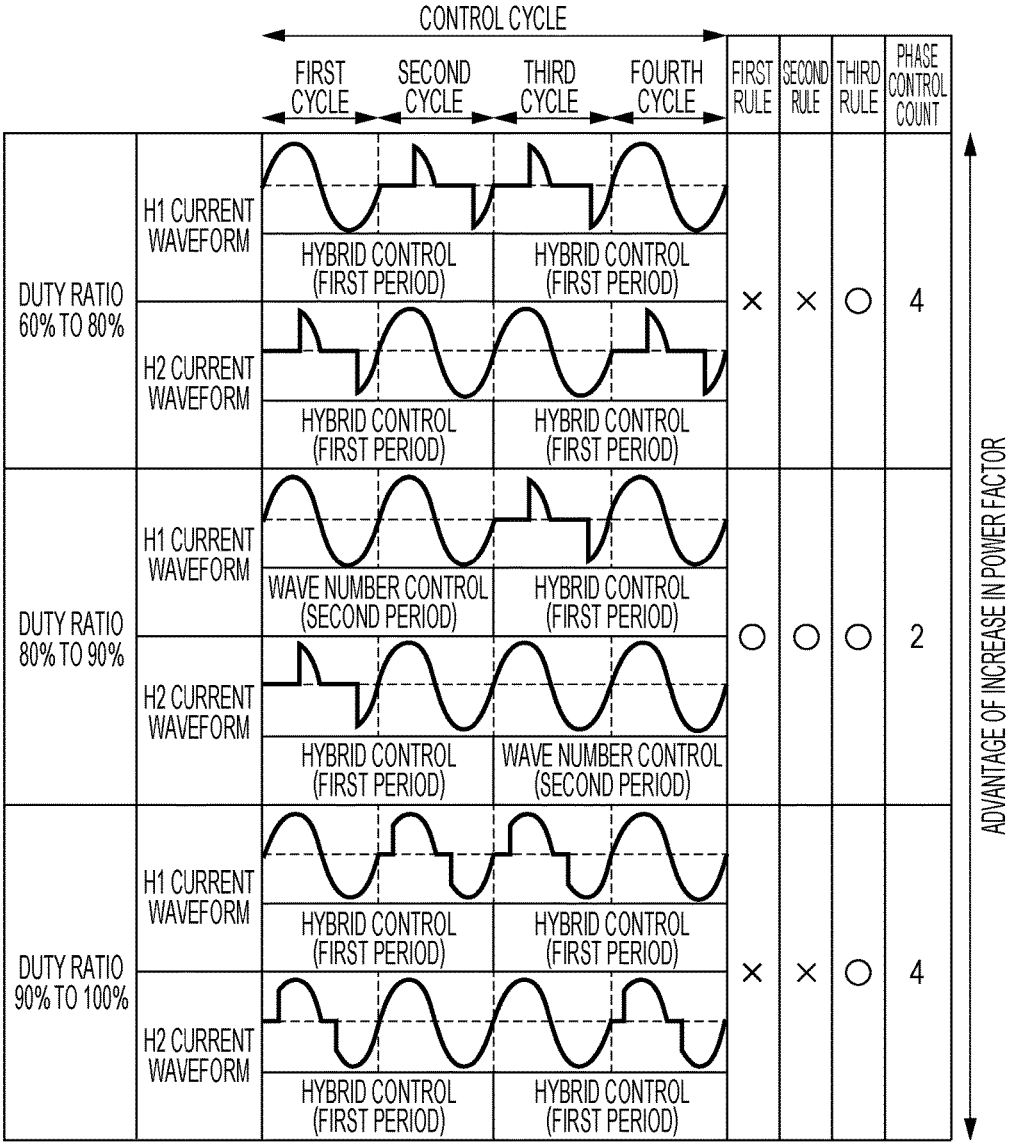

FIGS. 12A and 12B illustrate waveform tables according to the fourth embodiment. Columns on the right in FIGS. 12A and 12B are used to indicate whether or not the first to third waveform rules described above are satisfied. The number of phase control operations performed in the period of a control cycle (the number of cycles in which a phase control waveform appears) is also illustrated. The amplitude of a waveform having a duty ratio of 50% or less is illustrated as being larger than that of the waveform having a duty ratio which is more than 50%. This is because a waveform having a duty ratio of 50% or less is to be emphasized, and the size of an amplitude is to be ignored.

The current waveforms having a duty ratio of 60% or less satisfy all of the first to third rules, and the total of the number of phase control operations in four cycles in the first heating element H1 and that in the second heating element H2 is two. Therefore, this waveform enables occurrence of both of harmonic current and flicker to be suppressed. Power having a duty ratio of 60% or less is highly likely to be used in the period in which an unfixed toner image is fixed on a recording medium, and is unlikely to be used in the period in which the fixing device is warmed up until a state in which fixing operations may be successfully performed.

In contrast, a waveform having a duty ratio which is more than 60% has an advantage of an increase in the power factor. The period for which a larger power factor is desirable is a warm-up period in which a large amount of power needs to be provided to a heater in a short period. A large duty ratio is highly likely to be used in the warm-up period. Therefore, in the fourth embodiment, a waveform having a duty ratio which is more than 60% is set as a waveform having an advantage of an increase in the power factor.

The current waveforms for which duty ratios are in a range of 60% to 80% and in a range of 90% to 100% and in which the number of phase control operations is four do not satisfy all of the first to third rules. Therefore, the waveforms fail to suppress occurrence of harmonic current and flicker sufficiently. However, use of the waveforms in a short period such as a warm-up period causes no problem. In contrast, the waveforms for which duty ratios are in a range of 60% to 80% and in a range of 90% to 100% and which are illustrated in FIG. 12B improve the power factor. Therefore, a larger amount of power is supplied to the heater 119*c* compared with a case of a bad power factor. Accordingly, the waveforms are effective in heating the fixing device in a short period up to a temperature at which fixing operations may be successfully performed. Although the waveforms for which duty ratios are in a range of 80% to 90% have two phase control waveforms, the conduction angle of a phase control waveform may be set small. That is, although having two phase control waveforms, the waveforms may have a good power factor. Therefore, the waveforms satisfy all of the first to third rules.

Thus, the waveforms according to the fourth embodiment satisfy all of the first to third rules when the total of power supplied to the first heating element and power supplied to the second heating element in the period of a control cycle is at a power level (duty ratio) equal to or less than a predetermined level (duty ratio of 60% in the fourth embodiment). Waveforms for a level larger than the predetermined level have more phase control waveforms in a control time period than waveforms for a level equal to or smaller than the predetermined level. Thus, not only may occurrence of harmonic current and flicker be suppressed, but also a large amount of power may be supplied to a heating element.

Figure 13:
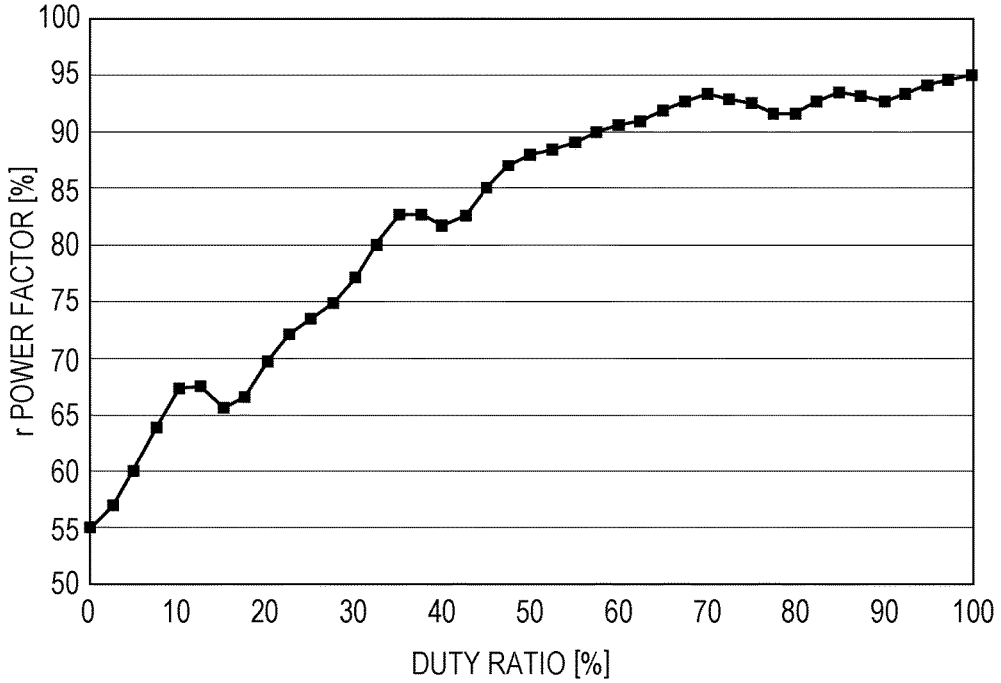
FIG. 13 is a diagram illustrating characteristics of a power factor.

FIG. 13 is a diagram illustrating the power factor of a composite current of the current Ic flowing to the power supply circuit unit 129 and the current It flowing to the heater 119*c*, when the current waveforms illustrated in FIGS. 12A and 12B are used. In the range of duty ratio of 60% or less, power may cause low power factors, but corresponds to a pattern in which occurrence of harmonic current may be suppressed, as described above. It is found that a duty ratio of 60% or more causes a high power factor.

Depending on the capacity of the smoothing capacitor 902, the phase angle of the current Ic flowing to the power supply circuit unit 129 is changed. Therefore, the combinations of the number of phase control operations in current waveforms and the amount of supplied power (duty ratio) which are illustrated in FIGS. 12A and 12B may be finely adjusted in accordance with the capacity of the smoothing capacitor 902.

As described in the first to fourth embodiments, when the total of power supplied to the first heating element and power supplied to the second heating element in the period of a control cycle is set to a level which is equal to or less than the predetermined level, currents having waveforms satisfying the first to third rules are made to flow. Thus, occurrence of harmonic current and flicker may be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-095775 filed May 8, 2015, which is hereby incorporated by reference herein in its entirety.

What is claimed is:

1. A fixing apparatus comprising:

a first heating element;

a second heating element;

a first switching element positioned in a power supply path from an alternating-current power supply to the first heating element;

a second switching element positioned in a power supply path from the alternating-current power supply to the second heating element; and a controller configured to control power supplied from the alternating-current power supply to the first heating element and the second heating element, for each control cycle, only having a first period and a second period having the same time length as that of the first period, of a plurality of predetermined cycles of alternating current flowing from the alternating-current power supply, wherein an image formed on a recording medium is thermally fixed on the recording medium by using heat generated by the first heating element and the second heating element, and wherein, when total power, comprising the power supplied to the first heating element and the power supplied to the second heating element, in the control cycle is set to a level which is equal to or less than a predetermined level, the controller is arranged to control the first switching element and the second switching element in such a manner that three following rules are satisfied, rule 1: in both of a waveform of an alternating current flowing through the first heating element and a waveform of an alternating current flowing through the second heating element, the first period and the second period are alternately present during the control cycle, the first period including both of a phase control waveform in which a current flows in a part of a half cycle of alternating current and a wave-number control waveform in which a current flows or does not flow over a half cycle of alternating current, the second period including only the wave-number control waveform, rule 2: when the first heating element operates in the first period, the second heating element operates in the second period, and when the first heating element operates in the second period, the second heating element operates in the first period during the control cycle, and rule 3: both the waveform of the alternating current flowing through the first heating element and the waveform of the alternating current flowing through the second heating element are electrically symmetric in the positive and negative directions during the control cycle.

2. The fixing apparatus according to claim 1, wherein the length of the first period matches the length of the second period.

3. The fixing apparatus according to claim 1, wherein the controller is arranged to control the first switching element and the second switching element in such a manner that both the waveform of the alternating current flowing through the first heating element and the waveform of the alternating current flowing through the second heating element are electrically symmetric in the positive and negative directions in a period of one cycle of alternating current.

4. The fixing apparatus according to claim 1, wherein the controller is arranged to control the first switching element and the second switching element in such a manner that the waveform of a current flowing through the first heating element in the first period matches the waveform of a current flowing through the second heating element in the first period, and that the waveform of a current flowing through the first heating element in the second period matches the waveform of a current flowing through the second heating element in the second period.

5. The fixing apparatus according to claim 1, wherein the controller controls the first switching element and the second switching element in such a manner that all of the three rules are satisfied regardless of the total power.

6. The fixing apparatus according to claim 1, wherein the predetermined level is the power level corresponding to a duty ratio of 60%.

7. The fixing apparatus according to claim 1, wherein, when the total power is larger than the predetermined level and the first heating element operates in the first period, the second heating element also operates in the first period, and when the first heating element operates in the second period, the second heating element also operates in the second period.

8. The fixing apparatus according to claim 1, wherein the length of the control cycle is equal to the length of four cycles of alternating current.

9. The fixing apparatus according to claim 1, wherein the length of the control cycle is equal to the length of eight cycles of alternating current.

10. The fixing apparatus according to claim 1, wherein the apparatus includes a cylindrical film and a heater having the first heating element and the second heating element, and the heater is in contact with an inner surface of the film.

11. A fixing apparatus comprising:

a first heating element;

a second heating element;

a first switching element positioned in a power supply path from an alternating-current power supply to the first heating element;

a second switching element positioned in a power supply path from the alternating-current power supply to the second heating element; and a controller configured to control power supplied from the alternating-current power supply to the first heating element and the second heating element, for each control cycle, only having one of a first period and a second period having the same time length as that of the first period, of a plurality of predetermined cycles of alternating current flowing from the alternating-current power supply, wherein an image formed on a recording medium is thermally fixed on the recording medium by using heat generated by the first heating element and the second heating element, and wherein, when total power, comprising the power supplied to the first heating element and the power supplied to the second heating element, in a the control cycle is set to a level which is equal to or less than a predetermined level, the controller is arranged to control the first switching element and the second switching element in such a manner that three following rules are satisfied, rule 1: in both of a waveform of an alternating current flowing through the first heating element and a waveform of an alternating current flowing through the second heating element, the first period and the second period alternately present in a period twice the control cycle, the first period including both of a phase control waveform in which a current flows in a part of a half cycle of alternating current and a wave-number control waveform in which a current flows or does not flow over a half cycle of alternating current, the second period including only the wave-number control waveform, rule 2: when the first heating element operates in the first period, the second heating element operates in the second period, and when the first heating element operates in the second period, the second heating element operates in the first period during the control cycle, and rule 3: both the waveform of the alternating current flowing through the first heating element and the waveform of the alternating current flowing through the second heating element are electrically symmetric in the positive and negative directions during the control cycle.

12. The fixing apparatus according to claim 11, wherein the controller is arranged to control the first switching element and the second switching element in such a manner that both the waveform of the alternating current flowing through the first heating element and the waveform of the alternating current flowing through the second heating element are electrically symmetric in the positive and negative directions in a period of one cycle of alternating current.

13. The fixing apparatus according to claim 11, wherein the length of the control cycle is equal to the length of two cycles of alternating current.

14. The fixing apparatus according to claim 11, wherein the apparatus includes a cylindrical film and a heater having the first heating element and the second heating element, and the heater is in contact with an inner surface of the film.

15. The fixing apparatus according to claim 1, wherein in rule 2, the second heating element commences operation at a termination of the first heating element operation.

16. The fixing apparatus according to claim 11, wherein the length of the first period matches the length of the second period.

17. The fixing apparatus according to claim 16, wherein in rule 2, the second heating element commences operation at a termination of the first heating element operation.

* * * * *